US006736412B1

(12) United States Patent
Krah

(10) Patent No.: US 6,736,412 B1
(45) Date of Patent: May 18, 2004

(54) KLOP SKATE HAVING PUSHING AND PULLING CAPABILITIES

(75) Inventor: Drew Krah, Vashon, WA (US)

(73) Assignee: K2 Corporation, Vashon, WA (US)

( * ) Notice: Subject to any disclaimer, the term of this patent is extended or adjusted under 35 U.S.C. 154(b) by 0 days.

(21) Appl. No.: 09/679,035

(22) Filed: Oct. 4, 2000

(51) Int. Cl.[7] ..... A63C 1/00

(52) U.S. Cl. ..... 280/11.224; 280/11.14; 280/11.27

(58) Field of Search ..... 280/600, 11.14, 280/11.15, 11.16, 11.224, 11.225, 615, 11.27, 11.28, 842, 11.12

(56) References Cited

U.S. PATENT DOCUMENTS

| | | | |
|---|---|---|---|
| 36,244 | A | 8/1862 | Starr |
| 63,946 | A | 4/1867 | Sanford |
| 601,013 | A | 3/1898 | Evans |
| 609,401 | A | 8/1898 | Biesel |
| 1,228,544 | A | 6/1917 | Falstrem et al. |
| 1,603,588 | A | 10/1926 | Eberle |
| 1,702,316 | A | 2/1929 | Ridgers |
| 1,751,692 | A | 3/1930 | Frühbeis |
| 1,789,182 | A | 1/1931 | Klevstad |
| 2,093,915 | A | 9/1937 | Klevstad |
| 2,120,987 | A | 6/1938 | Murray |
| 2,987,834 | A | 6/1961 | Howe |
| 3,114,562 | A | 12/1963 | Goodman |

(List continued on next page.)

FOREIGN PATENT DOCUMENTS

| | | |
|---|---|---|
| DE | 78733 | 1/1894 |
| DE | 484530 | 10/1929 |
| DE | 488768 | 12/1929 |

(List continued on next page.)

*Primary Examiner*—Brian L. Johnson
*Assistant Examiner*—J. Allen Shriver
(74) *Attorney, Agent, or Firm*—Christensen O'Connor Johnson Kindness PLLC

(57) ABSTRACT

A klop skate with pushing and pulling capabilities. In one alternate, the skate includes a glide member (110) for traversing a surface. The skate includes a shoe portion (112) for receiving a skater's foot. The skate has a base secured to the shoe portion (112) and underlying the received foot. The skate has a base lever (114) secured to the shoe portion base. The base lever (114) has a forward end portion and a forward base attachment structure (124) defined by the forward end portion. The base lever (114) has a longitudinal base lever axis aligned with a longitudinal axis of the received foot. The skate also includes an elongate frame (116) for mounting the glide member (110). The frame has a longitudinal axis, a forward end portion, and a forward frame attachment structure (136). The skate has a canted hinge (126) for connecting the forward end portion of the base lever (114) to the forward end portion of the frame (116). Upon pivoting of the base lever (114) with respect to the frame (116), a plane passing through the longitudinal axis of the base lever (114) defines an angle of canting with respect to a frame plane that extends vertically upward through the longitudinal frame axis. In another alternate, the skate includes a flexible connector (422) coupled to a cuff (420) and the forward end of the frame (406). The cuff (420) is attached to the lower leg of the skate wearer and the forward end attachment point is forward of the frame pivoting axis (410). Tensioning the connector (422) by flexing the foot distally causes the frame (406) to open relative to the base (402) which allows the skate-wearer to selectively hold the frame (406) in the open position. In another alternate, the skate includes a base (502) having a forefoot region (504) with an integral spring having a flex region (520) of zero bias strength, which allows the skate-wearer to hold the skate frame (508) open. In another alternate, the skate can include a biasing device 612 to bias the frame 604 away from the base 602.

21 Claims, 12 Drawing Sheets

U.S. PATENT DOCUMENTS

| | | | | | |
|---|---|---|---|---|---|
| 3,749,413 | A | | 7/1973 | Nicolson | |
| 3,900,203 | A | | 8/1975 | Kukulowicz | |
| 3,936,061 | A | | 2/1976 | Wada | |
| 4,061,348 | A | | 12/1977 | Carter | |
| 4,107,856 | A | | 8/1978 | Bourque | |
| 4,108,450 | A | | 8/1978 | Cote | |
| 4,126,323 | A | | 11/1978 | Scherz | |
| 4,272,090 | A | | 6/1981 | Wheat | |
| 4,309,833 | A | * | 1/1982 | Salomon | 280/615 |
| 4,470,205 | A | | 9/1984 | Olivieri | |
| 4,593,927 | A | * | 6/1986 | Salomon et al. | 280/615 |
| 4,815,753 | A | * | 3/1989 | Hue et al. | 280/615 |
| 4,839,972 | A | | 6/1989 | Pack et al. | |
| 5,014,450 | A | | 5/1991 | McGrath | |
| 5,184,834 | A | | 2/1993 | Yu | |
| 5,228,705 | A | | 7/1993 | Merle-Smith | |
| 5,257,793 | A | | 11/1993 | Fortin | |
| 5,342,071 | A | | 8/1994 | Soo | |
| 5,397,141 | A | | 3/1995 | Hoshizaki et al. | |
| 5,435,579 | A | | 7/1995 | Pozzobon | |
| 5,484,149 | A | | 1/1996 | Lee | |
| 5,498,009 | A | | 3/1996 | Young | |
| 5,503,413 | A | | 4/1996 | Belogour | |
| 5,505,467 | A | | 4/1996 | Hill et al. | |
| 5,586,774 | A | | 12/1996 | Dentale | |
| 5,634,648 | A | | 6/1997 | Tonel et al. | |
| 5,690,344 | A | | 11/1997 | Chen | |
| 5,704,620 | A | | 1/1998 | Oliemans et al. | |
| 5,797,608 | A | | 8/1998 | Haldemann | |
| 5,842,706 | A | | 12/1998 | Chang | |
| 5,890,724 | A | | 4/1999 | Gignoux et al. | |
| 5,904,359 | A | | 5/1999 | Caeran et al. | |
| 5,904,360 | A | | 5/1999 | Oliemans et al. | |
| 5,951,027 | A | | 9/1999 | Oyen et al. | |
| 5,957,470 | A | | 9/1999 | Powell | |
| 5,979,916 | A | | 11/1999 | Gatel et al. | |
| 6,007,075 | A | | 12/1999 | Shum | |

FOREIGN PATENT DOCUMENTS

| | | |
|---|---|---|
| DE | 488740 | 1/1930 |
| DE | 811095 | 7/1949 |
| DE | 25 27 611 | 12/1976 |
| DE | 35 42 251 | 6/1987 |
| EP | 0 192 312 | 8/1986 |
| EP | 0 568 878 | 4/1993 |
| EP | 0 551 704 | 7/1993 |
| EP | 0 774 282 | 5/1997 |
| EP | 0 778 058 | 6/1997 |
| EP | 0 799 629 A1 | 10/1997 |
| EP | 0 956 887 A1 | 11/1999 |
| FR | 2 642 980 | 8/1990 |
| FR | 2 659 534 | 9/1991 |
| FR | 2 672 812 | 8/1992 |
| FR | 0 599 403 | 6/1994 |
| FR | 2 749 183 | 5/1996 |
| GB | 505349 | 5/1939 |
| NL | 8702068 | 4/1989 |
| NL | 1014462 | 3/2000 |
| WO | WO 92/09340 | 6/1992 |
| WO | WO 92/11908 | 7/1992 |
| WO | WO 96/37269 | 11/1996 |
| WO | WO 97/32637 | 9/1997 |
| WO | WO 97/36655 | 10/1997 |
| WO | WO 98/47576 | 10/1998 |
| WO | WO 01/26755 A1 | 4/2001 |

* cited by examiner

KLOP SKATE HAVING PUSHING AND PULLING CAPABILITIES

FIELD OF THE INVENTION

The present invention relates to skates, and more particularly to klop skates having pushing and pulling capabilities.

BACKGROUND OF THE INVENTION

In competitive sports where a fraction of a second could mean the difference between winning gold and being out of the race for a medal, highly sophisticated sports equipment is a must for gaining an advantage over the competition. Ice speed skating records have recently been set by Olympic competitors competing with a new type of skate commonly referred to as a klop skate. A klop skate is a skate having a hinge which connects the frame, carrying the ice blade or wheels, with the shoe. The shoe generally sits on a rigid base. In some skates, it is the base that is pivotably connected to the frame at the hinge. A klop skate gets its name because of the "clapping" sound it makes when the lower frame portion and the base portion return forcibly to the closed position.

Before the introduction of klop skates, skater technique was highly emphasized in order to decrease a skater's time over a given distance. For example, a technique frequently used prior to the introduction of klop skates was to refrain from plantar flexing at the ankle. Plantar flexion is the term used to describe rotation of the ankle distally from the leg. A common example of plantar flexion is when a person pushes on a car accelerator. Skaters were coached to dorsiflex (opposite of plantar flex) the ankle when extending their leg during the power generating push stroke. In a normal person, as the leg is being pushed away from the body, the tendency is to plantar flex. However, plantar flexion for speed skaters is detrimental. Plantar flexion causes the ice skating blade or wheels to lose contact with the surface and the tip of the skate to point downward, potentially causing the tip to drag on the surface, thus slowing the skater. It has also been shown that the longer the skate glide member is in contact with the surface, the faster a skater is likely to go. Generally, by dorsiflexing, the skater can maintain longer contact between the skate and the ground as the power generating push stroke is effectively lengthened.

However, avoiding plantar flexion also means that the skater is prevented from using his or her calf muscles to assist in pushing. A skater using this technique does not realize the full potential of all of his or her muscle groups. Therefore, the klop skate, allowing the skater to plantar flex, was developed to aid the speed skater in achieving the goals of lengthening contact time between the skate with the surface, and utilizing the calf muscles during the pushing stroke.

Although the klop skate was a substantial achievement in the skating sport, the conventional klop skates do not address another problem typically regarded as inherent to skating. That is, a skater generally only utilizes one half of the potentially available power strokes which are possible. Normally, when a speed skater has completed the push stroke, and when the power leg is being returned to its resting position for the next push stroke with the opposite leg, the skater is merely gliding on the opposite leg. Therefore, nearly half of the time is spent gliding rather than positively generating a driving force. In order to overcome this problem, as with refraining from plantar flexion, skaters have been coached to assume a wholly unnatural body position by rotating the foot slightly about the ankle to an inward pointing alignment enabling the skater to maintain contact between the skate and the surface as the skater drew the leg inward in a pulling rather than pushing stroke. An inwardly aligned skate enables the skater to maintain contact between the glide member and the surface and return the foot to a position beneath the skater's body, while pulling himself forward. However, a skater may soon tire of this awkward position. In view of the shortcomings of the prior art, there exists a need for a klop skate which will allow a skater to utilize both a pushing and a pulling stroke.

SUMMARY OF THE INVENTION

The present invention pertains to klop skates which enable the skater to be able to plantar flex at the ankle. The skate boot is able to flex or pivot relative to the skate frame. The skates of the present invention permit a skater to utilize a pushing and pulling stroke. Push/pull skates facilitate propulsion through not only pushing during a stroke, but also through an inward pulling motion at the completion of a stroke by including either a canted hinge device connecting the skate frame to the shoe or by including devices that positively bias the frame away from the base, and also by devices that do not automatically bias the frame towards the shoe base. The latter is accomplished by either physically coupling a control device to the skater that counteracts biasing of the frame or by providing a shoe base that is constructed having a substantially neutral flexing base or a balanced frame, neither of which forcibly "klops" the frame or allows it to swing freely.

In one embodiment of the present invention, a skate includes a glide member for traversing a surface. The skate includes a shoe portion for receiving a skater's foot. The skate has a base secured to the shoe portion and underlying the received foot. The skate includes a base lever attached to the shoe portion base. The base lever has a forward end portion and a forward base lever attachment structure defined by the forward end portion. The base lever has a longitudinal base lever axis aligned and underlying a longitudinal axis of the received foot. The base lever defines a base lever plane, passing through the longitudinal base lever axis and perpendicular to the lower surface of the base. The skate also includes an elongate frame for mounting the glide member. The frame has a longitudinal axis, a forward end portion, and a forward frame attachment structure. The frame defines a frame plane passing through the frame longitudinal axis and perpendicular to the ground when the skate frame is fully upright. The skate includes a hinge that pivotally connects the forward end portion of the base lever to the forward end portion of the frame. The hinge is arranged such that upon pivoting of the base lever away from the frame, the base lever plane defines an angle of canting with respect to the frame plane. Stated another way, the longitudinal axis of the base lever, projected onto a horizontal plane (as defined with the skate frame in a fully upright position) passing through the longitudinal axis of the frame, defines the angle of canting with respect to the longitudinal frame axis.

In another embodiment of the invention, the base lever forward attachment structure is pivotably connected to the frame forward attachment structure. The hinge used to secure both structures is canted vertically, such that the pivot axis of the hinge forms an angle with respect to a horizontal plane passing through the longitudinal axis of the frame.

In another embodiment, the vertically canted hinge is adjustable, such that the angle of canting may be varied vertically.

In another embodiment, the base lever forward attachment structure is pivotably connected to the frame forward attachment structure. The hinge used to connect both structures is horizontally canted, such that the pivot axis of the hinge forms an angle with respect to a vertical plane extending perpendicular to the longitudinal axis of the frame.

In another embodiment, the horizontally canted hinge is adjustable, such that the angle of canting may be varied horizontally.

In another embodiment, the hinge may be horizontally and vertically canted, such that the hinge is adjustable both vertically and horizontally.

In a preferred embodiment, the frame forward attachment structure is formed from the forward end portion of the frame, the frame defining medial and lateral sides. The inner surfaces of the medial and lateral sides create a space for placement of the base lever forward attachment structure. The respective inner surfaces of the medial side and the lateral side of the frame forward attachment structure are at an angle with respect to a vertical plane (as defined by the skate frame in a fully upright position) passing through the longitudinal axis of the frame. The medial side and the lateral side each define a transverse aperture for receiving a hinge pin. The base lever forward attachment structure has a forward end portion having correspondingly angled side surfaces to mount in the space created by the medial side and the lateral side of the frame forward attachment structure. The base lever forward attachment structure defines a transverse passage through which the hinge pin is received, with the ends of the pin projecting from either side of the passage into the frame apertures. When the pin is mounted on the frame, the ends of the pin are at differing elevations relative to the ground. When the base lever forward attachment structure is mounted to the frame forward attachment structure by the hinge, the frame tends to assume a toe-in configuration, with the heel of the frame offset to the side upon pivoting of the base lever with respect to the frame. The glide member has a plurality of wheels, having their axis of rotation perpendicular to the frame. The wheels are attached to a lower portion of the frame substantially in an in-line fashion. Alternately, an ice skating blade may be employed.

In another preferred embodiment, the frame forward attachment structure has a tab projecting substantially vertically upward from a point proximate to the forward end of the frame. The tab is offset either medially or laterally with respect to the longitudinal axis of the frame. The tab is inclined on a central tab plane that creates an angle with respect to a vertical plane (as defined by the skate frame in a fully upright position) passing through the longitudinal axis of the frame. The tab has a transverse passage for mounting a hinge pin therein. The base lever forward attachment structure has two ears projecting substantially vertically downward, mounted proximate to the forward end portion of the base on lateral and medial sides thereof. The frame tab is received between the ears. Each of the two ears defines an aperture for mounting the hinge pin therein. The hinge pin extends through the aligned tab and ears. When the base lever forward attachment structure is mounted to the frame forward attachment structure by the hinge, the frame tends to assume a toe-in configuration, and the heel of the frame projects to the side upon pivoting of the base lever with respect to the frame. An ice skating blade is mounted on a lower portion of the frame. Alternately, skate wheels may be employed.

In another preferred embodiment, the frame forward attachment structure has a mounting member that is rotatably attached proximate to the forward portion of the frame. The rotating mounting member has a medial side and a lateral side. A hinge pin mounting passage is formed through the mounting member, extending from the lateral to the medial side. The planar shaped rotating member lies substantially horizontal on the frame. The rotating member is rotatably secured to the frame by at least one fastener. The fastener may be loosened to rotatably adjust the mounting member, or snugged to anti-rotatably secure the mounting member in place. The base lever forward attachment structure has two planar shaped ears projecting substantially vertically downward. The mounting member is received between the base lever ears. Each of the ears defines an aperture for mounting a hinge pin. The hinge pins pass through the base ears and are threadably engaged in the mounting member passage with their ends being received in the aperture of the ears. The glide member may be an ice skating blade or a plurality of skate wheels.

In another preferred embodiment, the klop skate of the present invention includes a shoe portion with a base, a base lever underlying the shoe base and a frame. The frame and the base lever are connected to each other at the forward end of the skate by a hinge, such that the frame can pivot about the hinge and swing open. The frame is biased closed by a spring. A force transmission linkage such as a cable attached to the skate-wearer at runs from a cuff fastened to the leg of the wearer to the forward end of the frame. Tensioning the cable by flexing at the ankle, produces an opposing force to the spring which allows the frame to swing open or to maintain an already open position. In an alternative, the cuff is pivotally attached to the shoe portion of the skate.

In another preferred embodiment, the klop skate of the present invention includes a shoe portion with a base, and a frame secured to the underside of the base forefoot region. The base has a forefoot region and a heel region. The forefoot region of the base is adapted to flex during skating, such that the frame can pivot and open. The base flex region is neutrally biased against urging the frame to the closed position. If the skate-wearer flexes at the metatarsal or phalangeal joint, the frame is directed downward and the frame is considered open.

In another preferred embodiment, the klop skate of the present invention includes a flexing base with a heel guide. The heel guide includes a biasing device which directs the frame away from the base to the open position. The heel guide also includes a controller to adjust the amount of biasing.

A skate constructed in the manners just described is meant to enable a push/pull skate which allows a skate-wearer to maintain the klop skate in an open position while lifting the gliding member off the surface or maintaining the glide member on the surface and redirecting the skate to an inward direction.

The present invention thus provides push/pull skates which includes a skate with a hinge that provides an inward purchasing, i.e., an inwardly configured glide member, and a skate which holds the skate frame open to prevent digging the forward tip of the frame into the surface.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
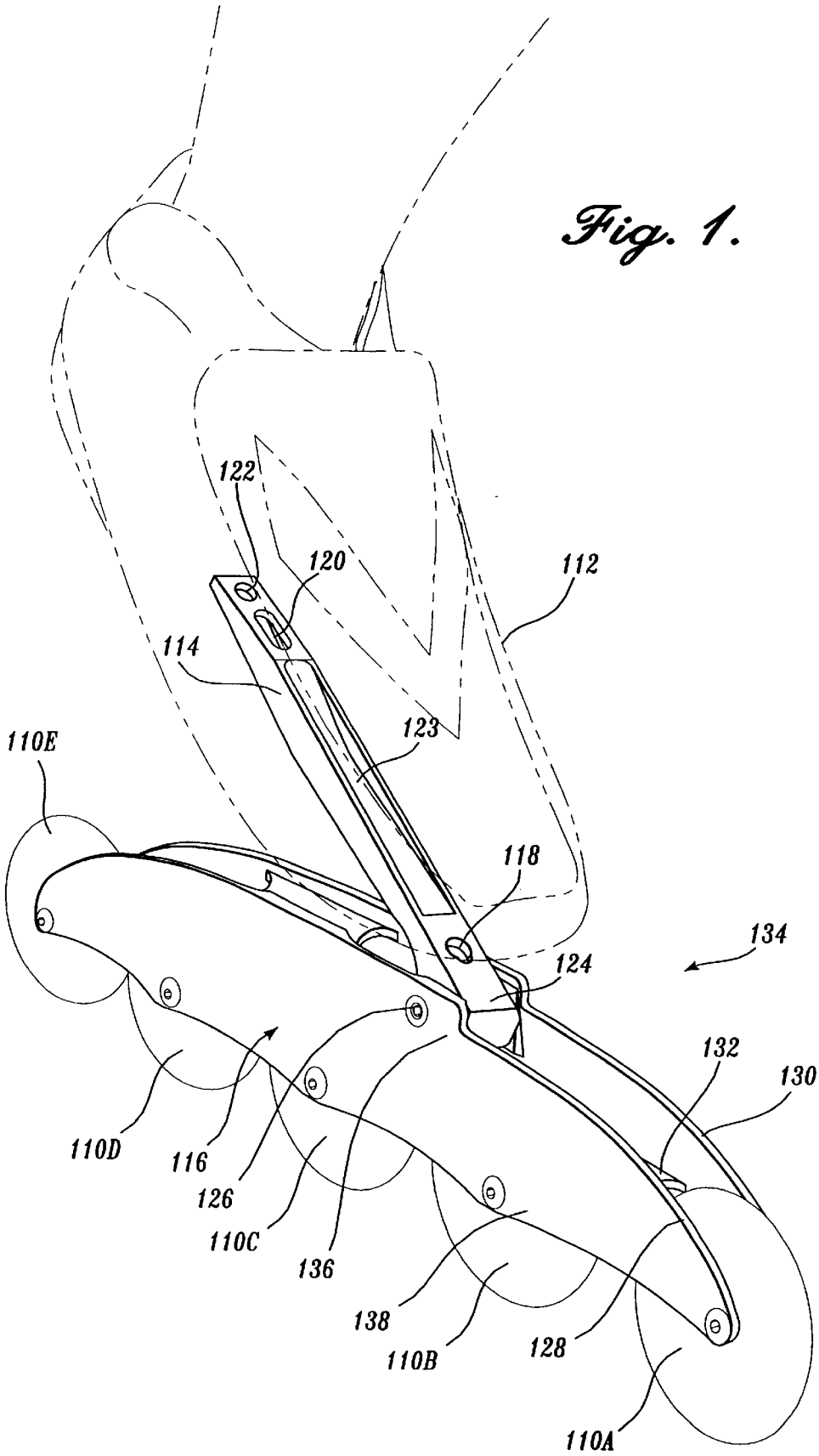
FIG. 1 provides a perspective view of one preferred embodiment of the present invention, with the shoe portion being shown in phantom.

A preferred embodiment of a canted klop skate in accordance with the present invention is illustrated in FIGS. 1–6. As show in FIG. 1, the skate includes a glide member 110 for traversing across a surface, a shoe portion 112 suitably including a rigid base (shown in phantom) for receiving the skater's foot, a base lever 114 secured longitudinally to the underside of the base of the shoe portion 112, a frame 116, on which the base lever 114 and the glide member 110 are mounted, and a hinge 126 for connecting the base lever 114 to the frame 116. The base lever 114 supports and carries the shoe portion 112. The shoe portion 112 is attached to the base lever 114 by fasteners, such as screws, bolts or rivets.

The embodiment illustrated in FIG. 1 includes apertures found in the base lever 114 for receiving the fasteners that secure the base lever 114 to this base. The base lever 114 includes an aperture 118 defined in a forward end portion of the base lever 114 for mounting one of the fasteners for attachment to a forward end of the shoe portion 112, preferably proximate to the forefoot or toe region. The base lever 114 may also include one or a plurality of apertures defined in the rear end portion of the base lever 114, such as an elliptical aperture 120 to accommodate shoe portions of varying sizes. The fastener can accordingly be slid forward or backward in the elliptically shaped aperture 120 before being snugged to the shoe portion 112. Still another aperture 122 may be provided proximate to the elliptically shaped aperture 120 for an additional fastener. While a shoe portion having a base secured to a separate base lever 114 has been described, it should be apparent, based on the disclosure contained herein, that the base lever 114 can be integrally incorporated into the shoe portion. This may be accomplished, for example, by providing a sufficiently rigid base, by molding a rib on the base, or by adhesive bonding. Likewise, the base and the shoe portion 114 may be separate or integrally formed.

The above described aperture 122 is suitably used for fastening to the shoe portion 112, but it may alternately be used to fasten a pedestal (not shown) or a pedestal stop (not shown), or a spring return mechanism (not shown) as part of a klopping mechanism.

In the embodiment of FIG. 1, the base lever 114 is an elongate shaped member defining a longitudinal axis, and generally having a planar uppermost surface to match the contours of the underside of the shoe portion 112. A slight elevation from the forward end portion of the base to the rear end portion is provided to match the shoe portion's lower contours. The base lever 114 has cutouts 123 or may otherwise provide weight-minimizing features to save on the overall weight of the shoe and skate combination. The base lever 114 includes a base lever forward attachment structure 124 located proximate to the forward end portion of the base lever 114. The base lever forward attachment structure 124 of this embodiment will be described in greater detail below, but first, the remaining structure of the skate frame 116 will be outlined to provide the background to intelligently speak of it. The base lever 114 is held to the frame 116 by a hinge 126, disposed traversely across the frame 116 and the base lever forward attachment structure 124. The hinge 126 is formed as a pin, as shall also be described below in conjunction when speaking of the base lever forward attachment structure 124.

Referring to FIG. 1, the elongate frame 116 has a lateral side wall 128 and a parallel medial side wall 130. As used hereinafter, lateral refers to the side of the person's foot which is on the outside, and medial refers to the side of the person's foot which is on the inside. The lateral side wall 128 and the medial side wall 130 are joined by a plurality of horizontal braces 132. The braces 132 are designed to provide sufficient strength, yet minimize the weight of the skate. At least one of the braces 132 positioned in the rear portion of the frame also serves the purpose of a pedestal for supporting the base lever 114 in the resting (non-pivoted) position. The elongate frame 116 defines a longitudinal axis running the length of the frame and has a forward end portion 134 for defining the frame forward attachment structure 136. The forward frame attachment structure will be described in greater detail below. By now it should be apparent that the base lever attachment structure, the frame attachment structure and the hinge are in cooperation with one another to provide a canted hinge. The frame 116 further includes a lower portion 138 for mounting the glide member 110. In this embodiment, the glide member 110 includes a plurality of wheels 110A, 110B, 110C, 110D, and 110E, arranged in line. However, other glide members for traversing across a surface may be used, such as an ice skating blade. In this embodiment, the glide member includes five wheels, however, the drawing should not be taken to be limiting, as a person of ordinary skill in the art may readily modify the frame of this embodiment to carry more or less wheels than shown. The wheels 110A–110E are journaled on axles between the lateral side 128 and medial side 130 of the frame 116, the rotational axis of each wheel being substantially perpendicular to the longitudinal axis of the frame, and arranged in an in-line fashion.

Figure 3:
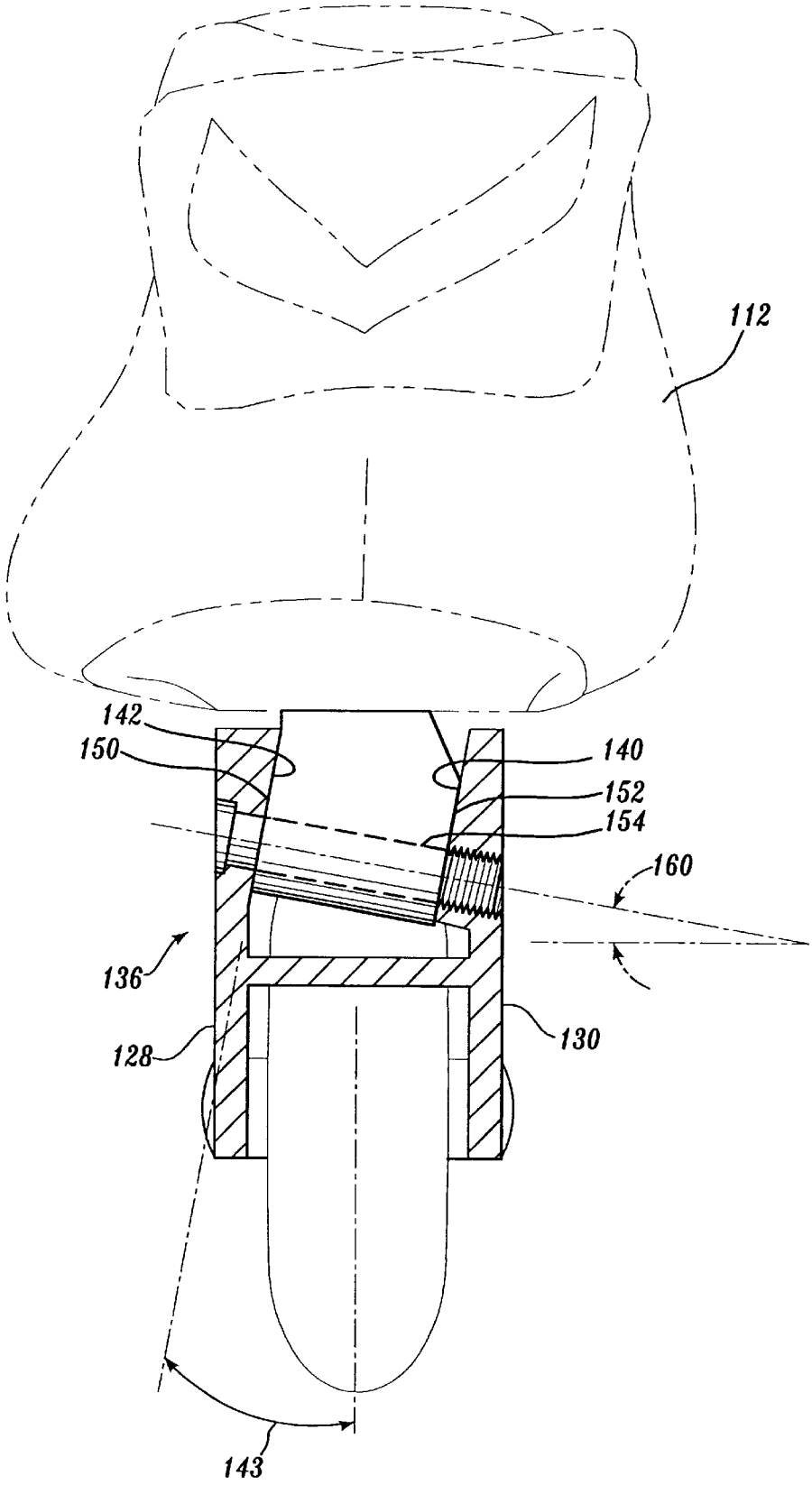
FIG. 3 provides a front plan view of the skate of FIG. 1, with the shoe portion shown in phantom.

Referring to FIG. 3, a more detailed description of the frame forward attachment structure 136 may now be undertaken. As mentioned above, the frame forward attachment structure 136 in this embodiment is formed from the forward end portion 134 of the frame 116. Preferably, the frame forward attachment structure 136 is fabricated from the same stock material as the frame, though it need not be so, and it is possible for a person of ordinary skill to fabricate it from a different stock and weld or otherwise attach it to the forward end portion 134 of the frame 116. The frame forward attachment structure 136 in this embodiment includes the formation of two angled planar surfaces 140 and 142. The planar surfaces 140 and 142 are defined on the medial side wall 130 and the lateral side wall 128, respectively, of the frame 116. The first of the two planar surfaces 142 creates an angle 143 with respect to a vertical plane passing through the longitudinal axis of the frame. To form an angled planar surface from the frame side wall, a portion of the lateral side wall 128 of the frame 116 has a wider thickness at the top of wall 128 and a narrower thickness toward the bottom area of the angled surface 142. On the opposite-facing planar surface 140, on the medial side 130 of the frame 116, the converse is true. In order to create an angled surface 140 having substantially the same, but opposite, angle as the lateral planar surface 142, the top thickness of medial wall 130 of the frame 116 is narrower than a corresponding bottom thickness of planar surface 140, as shown in FIG. 3.

While one alternate frame forward attachment structure has been described, other possibilities may exist for providing the same function. For example, instead of shaping the frame side walls, it is possible to introduce wedge-shaped pieces between the frame and the base lever to achieve the same canting effect. The frame forward attachment structure 136 of this embodiment will generally have a pair of parallel surfaces defining angles canted from the frame vertical plane. The amount and direction of canting will depend on numerous considerations, including whether the skate is for the left or the right foot and on the individual skating stroke of the wearer.

Figure 2:
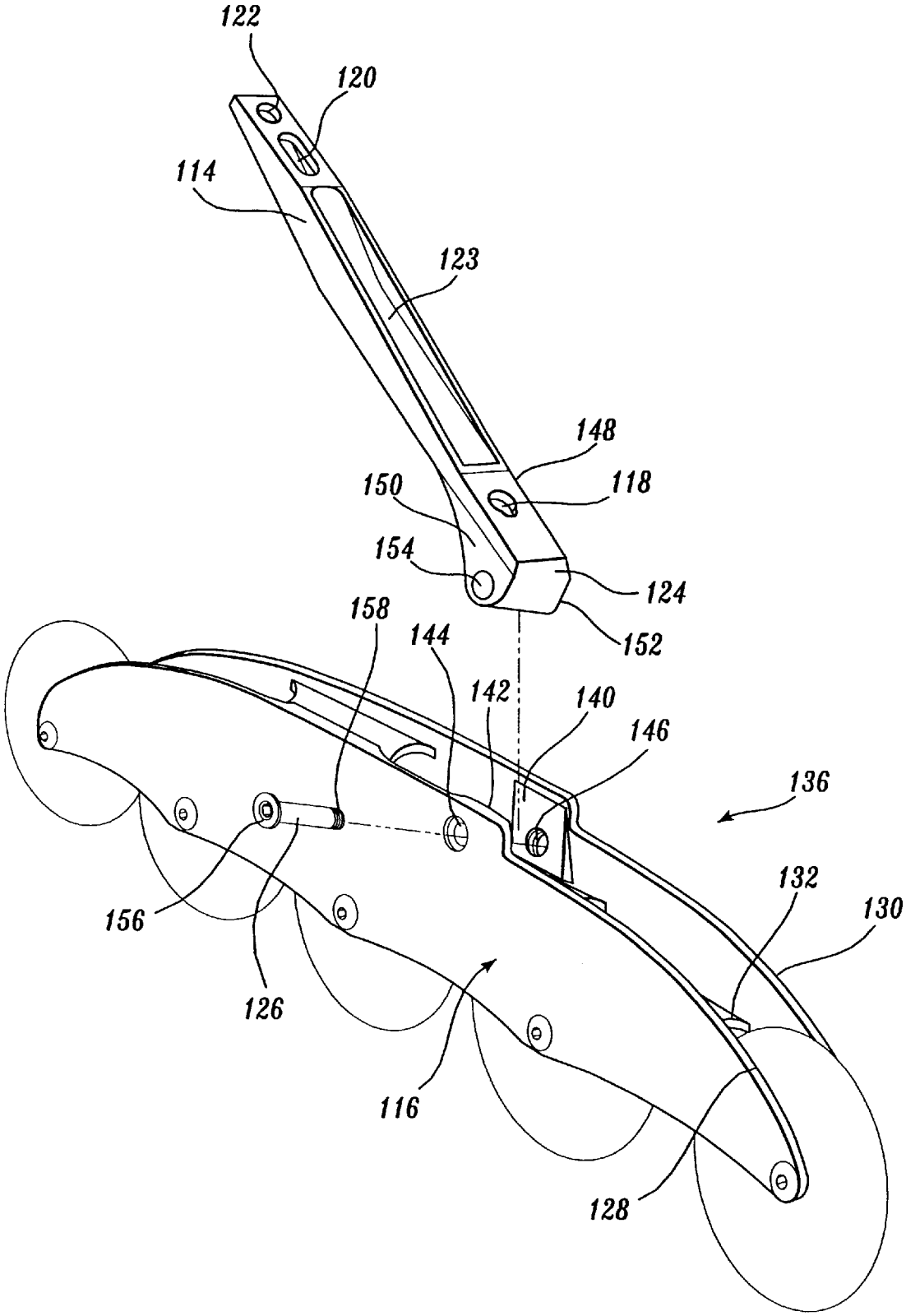
FIG. 2 provides an exploded perspective view of the skate of FIG. 1.

Referring to FIG. 2, apertures 144 and 146 are provided in the lateral side wall 128 and the medial side wall 130, respectively, of the frame 116, and more particularly in the frame forward attachment structure 136, for the purpose of mounting a hinge pin 126. The frame forward attachment structure 136, has a space between the lateral side surface 142 and the medial side surface 140 in the inner region of the frame 116 between the lateral side wall 128 and the medial side wall 130 for mounting the base lever 114.

Still referring to FIG. 2, the base lever 114 has a forward end portion 148 defining the base lever forward attachment structure 124. The base lever forward attachment structure 124 is preferably fabricated from the same stock material as the base lever 114, however, it is possible for a person of ordinary skill in the art to fabricate it from a different stock and weld or otherwise connect it to the forward end portion 148 of the base lever 114. The base lever forward attachment structure 124 has a lateral side surface 150 and a medial side surface 152. The base lever forward attachment structure lateral and medial side surfaces 150 and 152 are angled to substantially correspond to the angled planar surfaces 142 and 140 defined by the frame forward attachment structure 136. The base lever forward attachment structure 124 is inserted between the lateral side wall 128 and medial side wall 130 at the frame forward attachment structure 136, and attached therebetween with a hinge pin 126.

Low friction wear members (not shown) may be juxtaposed between the lateral and medial side surfaces 150 and 152 of the base lever forward attachment structure 124 and the lateral and medial planar surfaces 142 and 140 of the frame forward attachment structure 136 for reducing the wear between the base lever 114 and the frame 116. The low friction wear members prevent the surfaces of the base lever forward attachment structure 124 and the frame forward attachment structure 136 from rubbing or otherwise wearing away. The low friction wear members assist in prolonging the usable life of the skate. Preferably, the low friction wear members are replaceable and may suitably be constructed as roller bearings, polyamides or other low friction material bearings. In addition to low friction wear members, the base lever forward attachment structure 124 and the frame forward attachment structure 136 may include spacers, washers, nuts, and the like. As shown in FIG. 2, the base lever forward attachment structure 124 has a passage 154 defined on a lower region of the base lever forward attachment structure 124 traversing from the lateral side surface 150 to the medial side surface 152. The hinge pin 126 securely and pivotally fastens the base lever 114 to the frame 116.

Referring to FIG. 2, the hinge 126 suitably includes a bolt, screw or pin, having an elongate body and defining a longitudinal axis along the length of the body. In this embodiment, the hinge 126 is inserted through the lateral side wall aperture 144 and threadably connected in the medial side wall aperture 146. The hinge 126 will generally have a flattened head 156 to prevent the hinge 126 from sliding through lateral sidewall aperture 144 created in the frame forward attachment structure 136. The opposite end of the hinge has threads 158 to hold the hinge securely on the frame 116, thereby also securely holding the base lever 114 to the frame 116. The hinge 126 is mounted traversely on the lateral side aperture 144 and the medial side aperture 146 of the frame 116. The lateral side aperture 144 is at a higher vertical elevation with respect to the ground than the medial side aperture 146, such that when the hinge is mounted therebetween, the longitudinal axis (i.e., pivot) of the hinge 126 defines a discrete vertical angle of canting 160 with respect to a horizontal plane passing through the longitudinal axis of the frame 116 as shown in FIG. 3. The hinge 126 traverses the passage 154 defined on the base lever forward attachment structure 124 to hold the forward end portion of the base lever securely to the forward end portion of the frame 116.

Although one alternate for a hinge has been described, other alternates for a hinge may project through the medial side wall 130 of the frame 116 and be fastened with a nut, or both ends of the hinge may have threads, which may be either threaded to the frame or project through the frame sidewalls and then be fastened with nuts. Still other alternates may integrally combine the hinge with either the frame forward attachment structure or the base lever forward attachment structure. In these alternates, the hinge may appear on either structure as two pegs or balls on respective lateral and medial sides of the structure. The pegs would be inserted into corresponding sockets on the remaining respective structure. The hinge 126 may also include spacers, washers, nuts and the like.

In addition to the structures recited thus far, this embodiment may, as may the alternate embodiments of this invention, include a biasing device (not shown) for biasing the base lever 114 to the closed position with the frame 116. A biasing device may suitably be configured as a coil spring extending between the frame and the base lever.

A further embodiment will now be described with reference to FIG. 7. This embodiment is similar in operation to the previous embodiment, meaning that the skate of this embodiment will have a canted klopping hinge to cant the base lever as the klop skate opens. As with the earlier embodiment, the skate of FIG. 7, includes a glide member 210 for traversing across a surface, a shoe portion 212 including a rigid base (shown in phantom) for receiving the skater's foot, a base lever 214 secured longitudinally to the underside of the shoe portion base 212, a frame 216 on which the base lever 214 and the glide member 210 are mounted, and a hinge 226 for connecting the base lever 214 to the frame 216. The base lever 214 supports and carries the shoe portion 212. The shoe portion 212 is attached to the base lever 214 by fasteners, such as screws, bolts or rivets.

Figure 7:
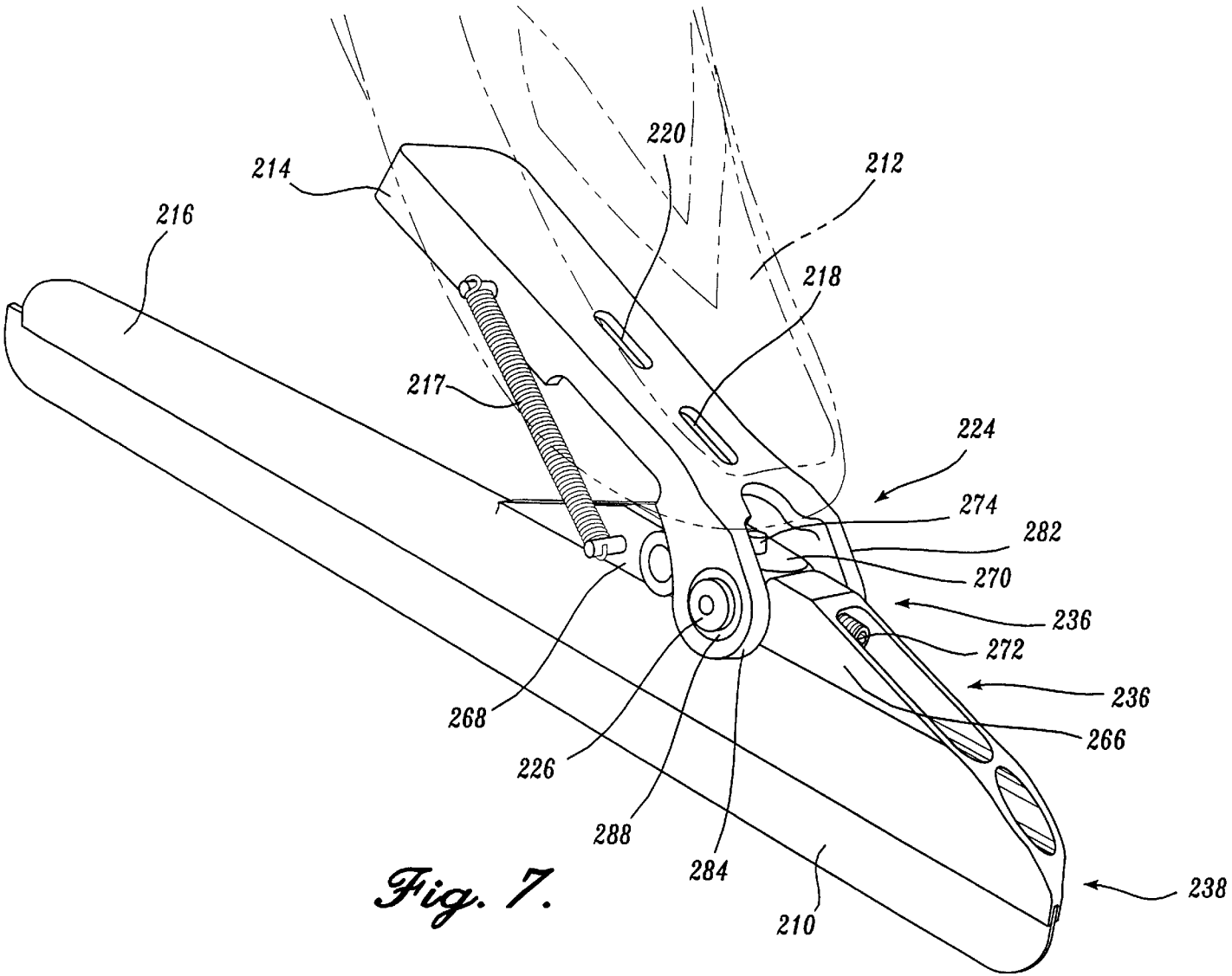
FIG. 7 provides a perspective view of a second preferred embodiment with the shoe portion shown in phantom.

The embodiment illustrated in FIG. 7 includes a plurality of apertures found in the base lever 214 for receiving the fasteners.

The base lever 214 includes a biasing device, such as a pair of springs, wherein one end of a spring 217 is attached to a rear portion of the base lever 214 and the other end of the spring 217 is attached to forward portion of the frame 216 to keep base lever 214 in the closed position relative to the frame 216. In this embodiment, a second spring (not shown) is similar in construction and operation as the first spring 217, but is located on the opposite side of frame 216 and base lever 214. A person of ordinary skill in the art may readily appreciate that any number of alternates for the biasing device may exist, such as elastomeric materials, which are suitable replacements for the spring biasing device 217. Depending on the biasing device chosen, the hardware to mount the biasing device would accordingly be revised. In this embodiment, the base lever 214 may include bolts, pins, screws, and accessories for attaching the spring biasing device 217.

Referring to FIG. 7, the base lever 214 may also include pedestals (not shown) for resting the base lever 214 on the frame 216. The shoe portion 212 is attached to the base lever 214 by fasteners, such as screws, bolts or rivets. In this embodiment, two elliptical apertures 218 and 220 are provided for fastening shoe portion 212 to base lever 214. Apertures 218 and 220 may be made elliptical to accommodate shoe portions of varying sizes or to place the shoe portion 212 at varying locations on the base lever 214. A fastener would accordingly slide forward or backward in the elliptically-shaped apertures 218, 220 before being tightened to the shoe portion 212. A person of ordinary skill in the art will recognize that the number of apertures defined on the base lever 214 may vary without detracting from the invention.

While a shoe portion having a base secured to a separate base lever 214 has been described, it should be apparent, based on the disclosure contained herein, that the base lever 214 can be integrally incorporated into the shoe portion 212. This may be accomplished, for example, by molding or adhesive bonding.

Figure 8:
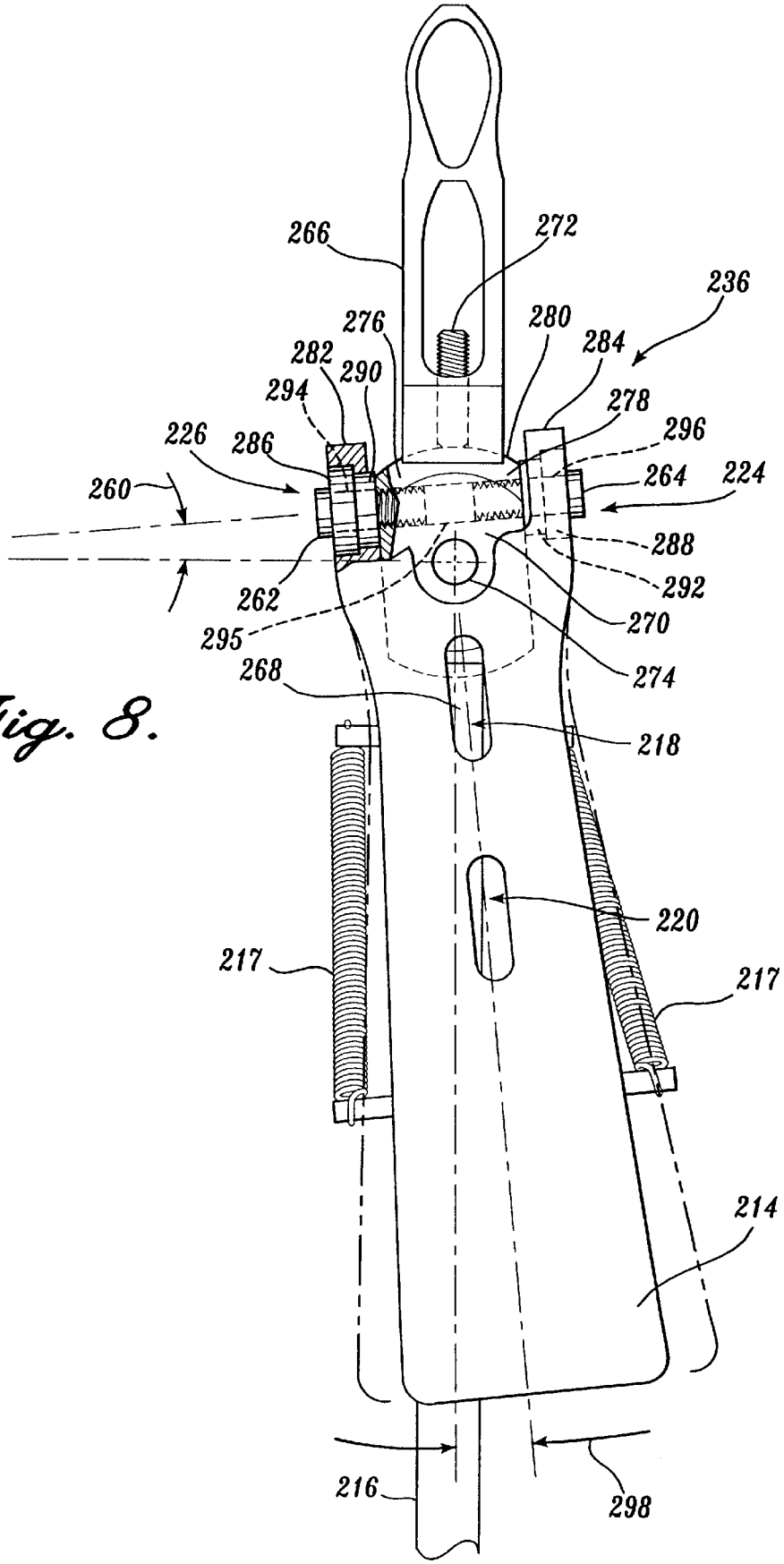
FIG. 8 provides a top plan view of the skate of FIG. 7.

Referring now to FIG. 8, the base lever 214 is an elongate shaped member defining a longitudinal axis, generally having a planar uppermost surface to match the contours of the underside of the shoe portion 212. The base lever 214 includes a forward attachment structure 224 located proximate to the forward end portion of the base lever 214. The base lever forward attachment structure 224 of this embodiment will be described in greater detail below. The base lever 214 is mounted to the frame 216 of the skate by a hinge 226, disposed on the frame 216 and traversing portions of the base lever forward attachment structure 224. The hinge 226 includes a lateral side hinge pin 262, and a medial side hinge pin 264. Each of the hinge pins 262, 264 is disposed traversely on one side of the frame forward attachment structure 236 to hold respective sides of the base lever forward attachment structure 224.

Referring to FIG. 8, the frame 216 is an elongate member defining a longitudinal axis running the length of the frame 216. The frame 216 has a frame forward attachment structure 236, which will be described in greater detail below. The frame 216 is generally constructed to resemble a tubular metal member. The hollow interior of the frame 216, reduces the weight of the overall shoe and skate combination. The frame 216 may include any number of pedestals or pedestal stops for resting the base lever 214 on the frame 216. A lower portion 238 of the tubular frame 216 defines a longitudinal slot for mounting the glide member 210. In this embodiment, the glide member includes an ice skating blade 210 mounted in the longitudinal slot. However, other glide members for traversing across a surface may be used with this embodiment, such as the in-line skate wheels of the embodiment shown in FIG. 1. The frame forward attachment structure 236 is constructed on the forward end portion of the frame 216. The frame forward attachment structure 236 serves to connect the base lever 214 to the frame 216.

Referring to FIG. 8, the frame forward attachment structure 236 of this embodiment has several components. The frame forward attachment structure 236, has a front bracket 266 and a rear bracket 268, mounted on the upperside of the frame 216, such that the front bracket 266 and the rear bracket 268 bracket a mounting member 270. The front bracket 266 and the rear bracket 268 of the frame forward attachment structure 236 are fabricated from the same stock material as the frame 216. However, a person of ordinary skill in the art, may readily fabricate front and rear brackets 266, 268 out of different stock material and weld or otherwise attach them to the frame 216. The mounting member 270 is part of the frame forward attachment structure 236.

The mounting member 270 is unique in its design, and its purpose is provide a structure on which the base lever 214 may pivot vertically, and the mounting member 270 further rotates about a center axis to adjust the horizontal angle of canting. The adjustable horizontally canting feature will be described in more detail below. The mounting member 270 resembles a sector of a sphere. When viewed from above, the outline is of a circular member that has right and left sectors removed, the sectors being defined by two parallel chords and their arcs. The chords are equidistant and parallel to a diameter of the circular outline; the diameter being substantially aligned with the longitudinal axis of the base lever 214. The mounting member 270 has a lateral side surface 276 and a medial side surface 278 where the sectors have been removed. Likewise, if viewed from the side, the outline of the mounting member 270 is of a circular member having its top and bottom sectors removed. The mounting member 270 has a top and bottom side surface where these sectors are removed. The front portion of the mounting member 280, thus is a sector of a sphere and the rear portion of the mounting member 270 is likewise similar in shape to the forward end portion and is a spherical sector. Front bracket 266 and rear bracket 268 surround front and rear potions of mounting member 270 and define substantially the negative of the spherical sectors, so as to accommodate the mounting member 270 between the space separating the front bracket 266 from the rear bracket 268. The front bracket 266 includes a first fastener 272 for securing mounting member 270. The fastener 272 is aligned along the longitudinal axis of the frame 216. Fastener 272 has threads throughout its entire length. Fastener 272 traverses a threaded passage of the front bracket 266, thus is able to butt against front portion of mounting member 270. Fastener 272 is provided with an Allen socket at the front end to enable turning of fastener 272 in the threaded passage. As fastener 272 turns, the rear end of fastener 272 snugs against the front end of mounting member 270, thus holding mounting member 270 at the desired horizontal angle. A second fastener 274 is provided for securing the mounting member 270 to the frame 216. The fastener 272 traverses mounting member 270 at its center, thus providing the axis for rotation.

Fastener 274 may be any fastener suitable in such applications, such as a pin, screw, bolt, and the like. In cooperation with fastener 272, fastener 274 may also be snugged against mounting member 270 to hold mounting member 270 at its desired position. To adjust the horizontal angle 260, fasteners 272 and 274 are loosened, mounting member 270 is thus free to rotate about the center axis. Once horizontal angle 260 is fixed, fasteners 272 and 274 are snugged once more.

Referring to FIG. 8, the mounting member 270 has a transverse passage defined from the lateral side 276 to the medial side 278 of mounting member 270. Alternatively, mounting member 270 may have a first and second aperture on the lateral side and the medial side, respectively, not extending the entire length of mounting member.

Referring to FIG. 8, the base lever forward attachment structure 224 is defined on the forward end portion of the base lever 214. The base lever forward attachment structure 224 is machined from the same stock material as the base lever 214, though it need not be so. A person of ordinary skill will readily appreciate that a base lever forward attachment structure 224 may be fabricated separately and then welded or otherwise attached to the forward end portion of the base lever 214. The base lever forward attachment structure 224 has two planar shaped ears 282 and 284 projecting substantially vertically downward (shown more clearly projecting downward and laterally of mounting member 270 in FIG. 7). A first ear 282 is disposed laterally with respect to the longitudinal axis of the base lever 214, while the second ear 284 is disposed opposite the lateral ear 282 and medially of the longitudinal axis of the base lever 214. The lateral ear 282 and the medial ear 284 are separated to form a space, such that the mounting member 270 may be received within the space between the inner surface of the lateral ear 282 and the inner surface of the medial ear 284. Apertures are defined on each of the respective ears for mounting a hinge pin 262, 264. The lateral ear 282 and the medial ear 284 are placed respectively on the lateral side surface 276 and the medial side surface 278 of the mounting member 270 such that base lever ear apertures 294 and 296 are aligned with the mounting member passage, enabling the hinge pins 262 and 264 to threadably engage the mounting member passage 295 from either the lateral and medial ears, respectively. Low friction bearings 286 and 288 are located on the outer surface of the lateral ear 282 and the outer surface of the medial ear 284, respectively. Spacers 290 and 292 are located on the inner surface of the lateral ear 282 and the inner surface of the medial ear 284, respectively. Alternatively, low friction bearings 286, 288 may be located on the inner surfaces of the respective base lever ears 282, 284, or on the mounting member 270. Low friction bearings may be roller bearings or made of a durable low friction material. The base lever forward attachment structure 224 and the frame forward attachment structure 236 can be securely fastened to one another by a hinge 226.

Referring to FIG. 8, the hinge 226 includes two elongated fasteners, such as pins, bolts, screws or the like, each defining a longitudinal axis. In the embodiment of FIG. 8, the hinge 226 has two pins 262 and 264. The first pin 262, extends through the lateral ear aperture 294 and secures to the lateral side surface 276 of the mounting member 270 at the mounting member passage 295. The second pin 264 extends through the medial ear aperture 296 and secures to the medial side surface 278 of the mounting member 270 at the mounting member passage 295. Low friction bearings 286, 288 may be disposed between the hinge heads, i.e., the large diameter portion of the pin that snugs against the base lever forward attachment structure 224, and each of the respective lateral and medial ears 282 and 284 as described above. Although in this embodiment, two pins have been used to secure the base lever forward attachment structure 224 to the frame forward attachment structure 236, a single fastener may be used which extends completely through the mounting member passage 295. In one such embodiment, the fastener would traverse either the lateral or medial ear to be threadably engaged on the opposite ear. Alternatively, the fastener may traverse both ears entirely and be fastened with a nut on the outside of one ear.

Having provided the structures described above, the base lever 214 is mounted squarely on lateral and medial sides of mounting member 270 such that the longitudinal axis of base lever 214 forms right angles with hinge pivot axis 226. Horizontal canting angle 260 is adjusted by swiveling the mounting member about the center axis point 274, such that hinge pivot axis can move away from a perpendicular line drawn with respect to the frame longitudinal axis. Angle 260 further translates into angle 298 which is defined by a frame plane drawn through the longitudinal axis of the frame 216 when the frame is in the upright position and by a base plane drawn through the longitudinal axis of the base lever 214. As the base lever 214 opens during normal use, such as when a skater plantar flexes the ankle, the angle 298 defined by these two planes remains constant so that upon completion of the pushing stroke, alignment of the foot axis to the normal forward pointing position will cause a skate to be angled slightly inward. As can be seen in FIG. 8, if the base lever 214 were aligned in a straight forward pointing position, the toe of the frame 216 would point in and the heel would point out. This allows a skater to more readily use a pulling stroke without unnaturally over-rotating at the ankle.

Figure 9:
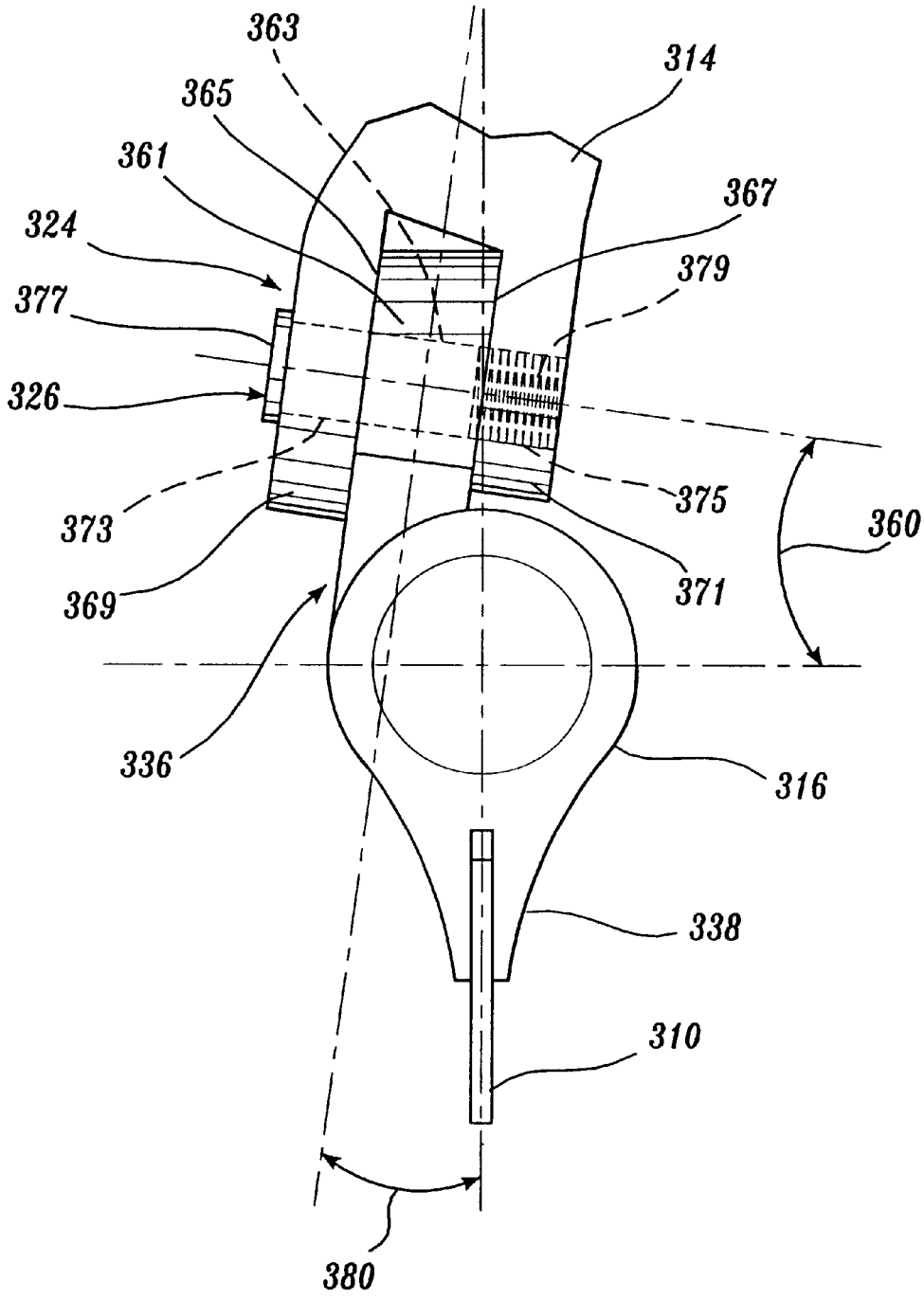
FIG. 9 provides a front plan view of a third preferred embodiment.

A further embodiment will now be described with reference to FIG. 9. This embodiment is similar in operation to the previous embodiments, meaning that the skate of this embodiment will have a canted klopping hinge to cant the base lever as the klop skate opens. As with the earlier embodiments, the skate of FIG. 9, includes a glide member 310 for traversing across a surface, a shoe portion and base (not shown), a base lever 314, a frame 316 on which the base lever 314 and the glide member 310 are mounted, and a hinge 326 for connecting the base lever 314 to the frame 316. The base lever 314 is intended to carry the shoe portion. Accordingly, the base lever 314 may include any number of fasteners or apertures in order to secure the shoe portion on the base lever 314. It should also be apparent based on the disclosure contained herein that the base lever can be integrally incorporated into the shoe portion. In the embodiment of FIG. 9, the base lever 314 is an elongate shaped member defining a longitudinal axis, and generally having a planar uppermost surface to match the contours of the underside of the shoe portion.

Referring to FIG. 9, the frame 316 is generally constructed of a tubular metal member. The hollow interior of the frame 316 reduces the weight of the overall base lever and frame combination. A lower portion 338 of the tubular frame 316 defines a longitudinal slot for mounting the glide member 310. As with the previous embodiments, the frame 316 is generally elongate, defining a longitudinal axis and having a forward end portion. The frame forward attachment structure 336 is located on the forward end portion of the frame 316. The frame forward attachment structure 336 is preferably made from the same stock material as the frame 316, however, a person of ordinary skill will readily appreciate that the frame forward attachment structure 336 may be fabricated separately and welded or otherwise attached to the frame 316. The frame forward attachment structure 336 includes a planar shaped tab 361 projecting substantially vertically upward from proximate the forward end of the frame. The tab 361 is mounted either laterally or medially with respect to the longitudinal axis of the frame 316. In this embodiment, the tab 361 is mounted laterally, however, this should not be construed as limiting, since the other skate in a pair would have the tab mounted medially with respect to the longitudinal axis of the frame. The tab 361 is offset either medially or laterally with respect to the longitudinal axis of the frame 316. The tab 361 is inclined on a central tab plane that creates an angle 380 with respect to a vertical plane (as defined by the skate frame in a fully upright position) passing through the longitudinal axis of the frame 316. The tab 361 has a passage 363 extending from the tab lateral surface 365 to the tab medial surface 367. The passage 363 is suitably constructed so as to accept hinge 326 at an angle. As with the previous embodiments, the frame forward attachment structure 336 is suitably adapted to receive the base lever forward attachment structure 324.

Referring to FIG. 9, the base lever 314 is generally an elongate member, having a longitudinal axis, with a forward end portion defining the base lever forward attachment structure 324. The uppermost surface of the base lever 314 is generally planar, and may be adapted for the contours of the corresponding shoe portion. Apertures are defined on the base lever 314 extending through to the base lever surface for receiving fasteners to securely hold the shoe portion to the base lever 314. The base lever forward attachment structure 324 defined on the forward end portion of the base lever 314 is fabricated from the same stock material as the base lever 314. However, it need not be so, and it is possible for a person of ordinary skill to fabricate the base lever forward attachment structure 326 from different stock material and weld or otherwise connect it to the forward end portion of the base lever 314. The forward end portion of the base lever 314 has two planar shaped ears 369 and 371, projecting substantially vertically downward. A first ear 369 is mounted laterally with respect to the longitudinal axis of the base lever 314, and the second ear 371 is mounted opposite with respect to the first ear 369 and medially with respect to the longitudinal axis of the base lever 314, such that the two ears are separated by a space for receiving tab 361 therein. A first aperture 373 extends through the lateral ear 369, and a second aperture 375 defined on the medial ear 371 also extends through the medial ear 371. Apertures 373, 375 are suitably formed at an angle to receive the hinge 326 at a vertical angle. The base lever forward attachment structure 324 and the frame forward attachment structure 336 substantially as described above can be secured to one another by the hinge 326 to allow for pivoting of the base lever 314 with respect to the frame 316.

Referring to FIG. 9, the hinge 326 is generally an elongate member, defining a longitudinal axis. The hinge 326 can be a fastener, such as a pin, screw, bolt or the like, capable of securing the base lever forward attachment structure 324 to the frame forward attachment structure 336. In this embodiment, the hinge 326 is a bolt having a flattened head 377 on one end and threads 379 on the opposite end. The bolt 326 extends through the lateral ear 369 and the tab passage 363 such that the threads 379 of the bolt 326 engage the medial ear 371. Alternatively, if the medial ear does not provide a threaded passage, the hinge may traverse the medial ear, in which case, the hinge would be fastened by a nut on the outside of the medial ear 371. When the hinge 326 is constructed in accordance with the present invention, the longitudinal axis of the hinge 326 will define a discrete vertical angle of canting 360 with respect to a horizontal plane. The hinge 326 and the base lever forward attachment structure 324 and the frame forward attachment structure 336 may include anti-friction devices such as roller bearings and the like. Additionally, any number of spacers, washers, nuts, and the like may also be included.

Figure 4:
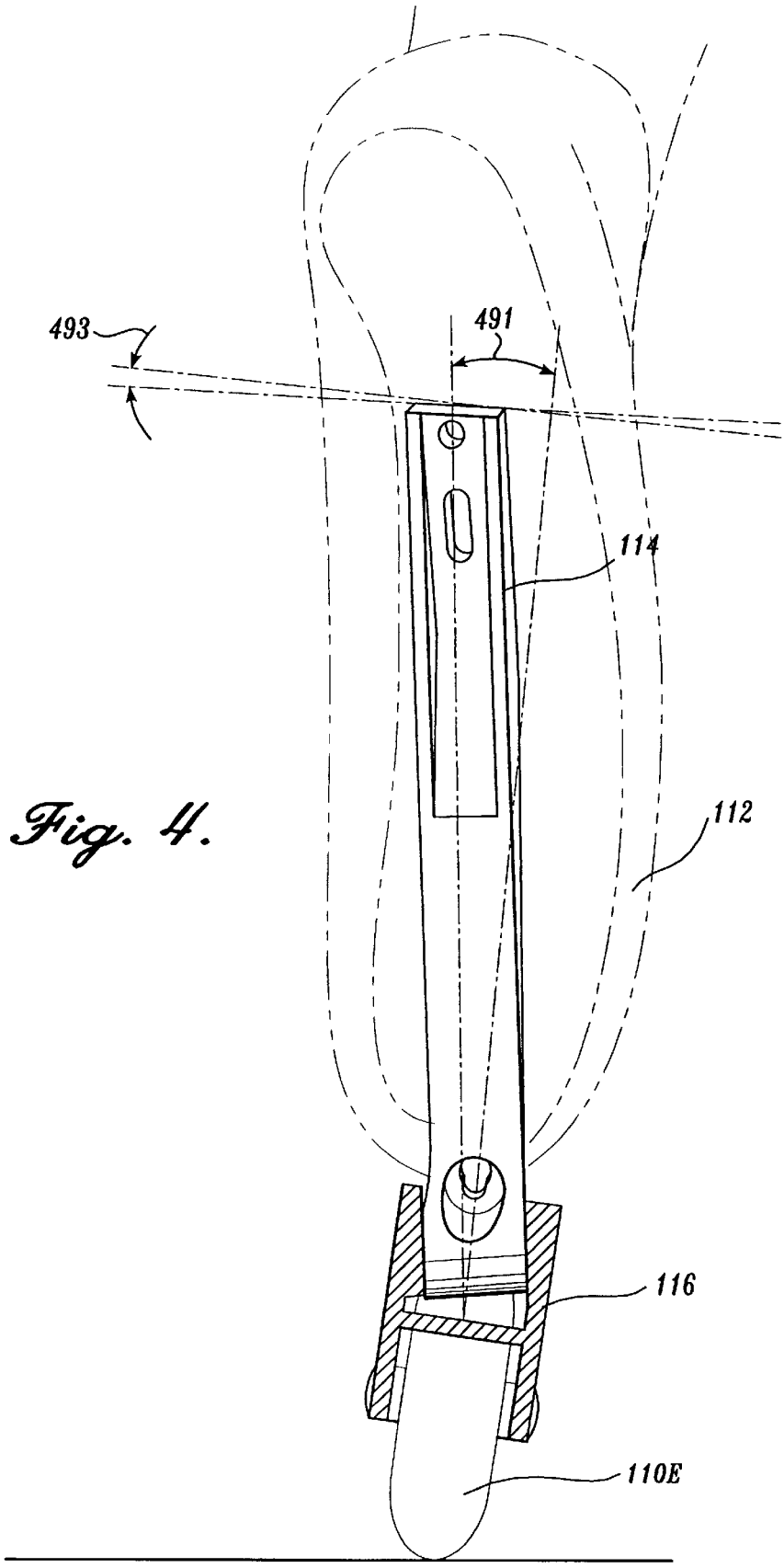
FIG. 4 provides a back plan view of the skate of FIG. 1, with the shoe portion shown in phantom and the base lever pivoted with respect to the frame.
Figure 5:
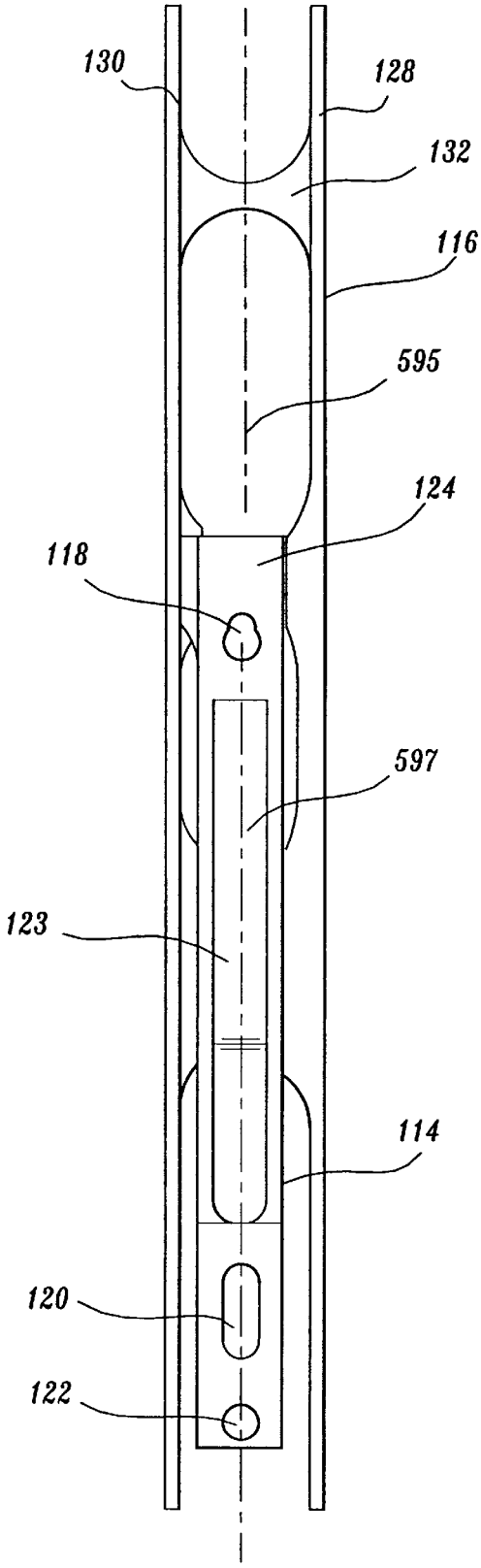
FIG. 5 provides a top plan view of the skate of FIG. 1.

With respect to the embodiment represented by FIGS. 1–6, and the embodiment represented by FIG. 9, having the discrete or predetermined vertical canting aspect of the invention, a particular feature in common will now be described. Both of these embodiments have a base lever forward attachment structure pivotally connected to the frame forward attachment structure, wherein the hinge is vertically canted so that the pivot axis of the hinge defines a discrete vertical angle of canting with respect to a horizontal plane. This feature is shown as elements 160 and 360 in FIGS. 3 and 9, for each of the respective embodiments. In the closed position, these embodiments assume a neutral angle of canting as shown in FIG. 5. When the base lever starts to open, the angle of canting 699 enlarges from substantially 0 degrees to the discrete vertical angle represented by angle 160 (FIG. 3), shown in FIG. 6 as element 699. As a theoretical limit, the hinge vertical angle of canting may not exceed 90 degrees. More practical however, the vertical angle should be in the range of about 0 degrees to about 60 degrees. Additionally, the frame may heel to the side, shown as element 491 of FIG. 4, and twist, shown as element 493 of FIG. 4. This is due to the mechanical translation of the vertical angle imparted by the canted hinge to the adjoining structures as the base lever pivots about the canted hinge.

In a further alternate embodiment with respect to those embodiments already possessing discrete vertical canting as represented in FIGS. 1–6 and 9, there is the possibility of adjusting the vertical angle of canting by raising or lowering either one or both ends of the hinge. This may be accomplished by providing elliptically shaped passages on the base lever forward attachment structure or on the frame forward attachment structure or both. The base lever forward attachment structure may also be constructed as to allow up and down movement of the hinge through varying degrees of canting. The skate of this embodiment will thus be aptly suited to accommodate different skaters having different skating strokes by the simple mechanical expedient of adjusting the hinge vertically upward or downward.

With respect to the embodiment represented by FIGS. 7 and 8, which possesses adjustable horizontal canting, other embodiments may be so constructed as to eliminate the adjustable horizontal canting feature, providing only discrete horizontal canting. This will be desirable when the skate is specifically tailored to a single individual. Elimination of the adjustability feature will save on weight, so as to reduce skater fatigue. These embodiments will generally have a base lever forward attachment structure pivotably connected to the frame forward attachment structure so that the hinge is discretely horizontally canted. The pivot axis of the hinge will thus define a horizontal angle with respect to a vertical plane perpendicular to the longitudinal axis of the frame.

In addition, other embodiments are possible and within the scope of this invention. For example, a skate having discrete vertical canting in combination with discrete horizontal canting or a skate having both adjustable vertical and adjustable horizontal canting, or a skate with adjustable vertical canting and discrete horizontal canting or a skate having discrete vertical canting and adjustable horizontal canting. A person of ordinary skill in the art can readily modify the embodiments herein described to arrive at the various combinations.

Figure 6:
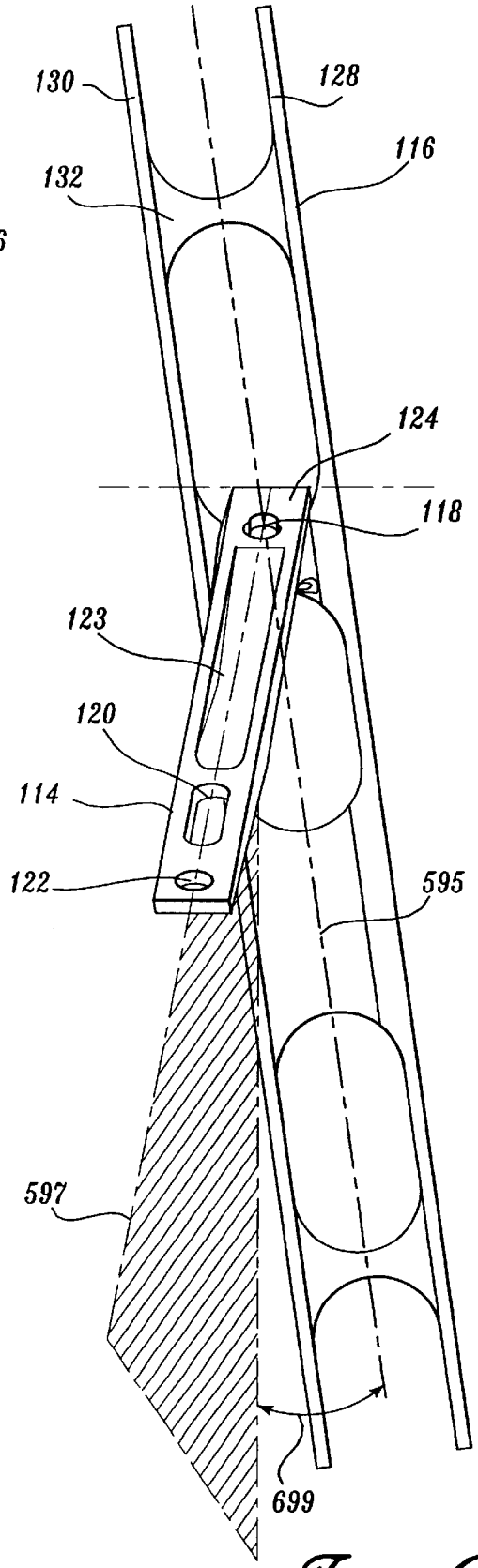
FIG. 6 provides a top plan view of the skate of FIG. 1, with the base lever pivoting with respect to the frame.

The operation of the different embodiments will now be described with reference to FIGS. 4, 5, and 6. Although it is with reference to one embodiment, other embodiments constructed in accordance with the present invention possess the same generic feature. As described above, the preferred embodiments include a glide member for traversing a surface, a shoe portion with a base for receiving a skater's foot, a base lever secured to the shoe portion base, the base lever defining a longitudinal base lever axis aligned with a longitudinal axis of the received foot. The base lever defines a base lever plane, passing through the longitudinal base lever axis and perpendicular to the lower surface of the base. The skate also includes an elongate frame for mounting the glide member, the frame defining a longitudinal frame axis. The frame defines a frame plane passing through the frame longitudinal axis and perpendicular to the ground when the skate frame is fully upright. A hinge, defining a pivot axis, pivotably connects the forward end portion of the base lever to the forward end portion of the frame joining the base lever attachment structure to the frame attachment structure so that upon pivoting of the base lever away from the frame, the base lever plane defines an angle of canting with respect to the frame plane. Stated another way, the longitudinal axis of the base lever projected onto the horizontal plane (as defined with the skate frame in a fully upright position) passing through the longitudinal axis of the frame defines the angle of canting. FIG. 5 shows a particular embodiment using vertical canting. The base lever 114 is in the closed position relative to the frame 116. The base lever 114 suitably rests on a pedestal secured to the frame 116. When in a closed position, the longitudinal axis 597 of the base lever is coincident with the longitudinal axis 595 of the frame. Upon opening of the klop skate, as for example when the skater plantar flexes at the ankle, so as to maintain the glide member in contact with the surface, the base lever plane passing through the longitudinal axis 597 of the base lever 114 defines an angle of canting 699 with respect to a frame plane that extends vertically upward through the longitudinal frame axis 595, as shown in FIG. 6. This is true of embodiments which use vertically or horizontally canted hinges. In this instance, this angle of canting is created by the translation of the vertically canted hinge to the adjoining base lever and frame structures. Embodiments utilizing horizontally canted hinges, will generally begin with an angle of canting predetermined at the start.

The angle of canting is roughly determined for an individual skater by measuring the angle created by the foot when the foot is at its furthermost position during the pushing stroke, the angle being defined by the longitudinal axis of the foot, and the line indicating forward direction of motion. This angle roughly corresponds to the needed angle of cant to allow the skater to, at stroke end, point his foot forward thus, redirecting the frame from toe out to toe in, allowing the pull motion. FIG. 8, shows that the angle of canting 298 for a particular embodiment using adjustable horizontal canting may be greater than zero when the base lever is in the closed position. During skating, as the skater completes the push stroke and the skater has extended the pushing leg as far as it will go, the skater may realign his foot to a naturally comfortable forward-pointing position. When the skater's foot is aligned straightforward and the base lever is open, a skate having the structures as substantially described above, will inwardly self-align itself. In other words, the tip of the skate will point inward, thus allowing the skater to maintain contact with the surface while inwardly drawing the leg. The canting of the skate in the manner described facilitates use of a pulling stroke. By having the skate cant at an angle, the skater does not need to over-rotate at the ankle, thus preventing skater fatigue and gaining a decided advantage over competitors having merely conventional klop skates.

With vertically canted base levers, the skate frame may additionally heel to one side as well as be inwardly aligned. The heeling action is a result of the mechanical structure having a vertically canted hinge. For example, this heeling action is illustrated in FIG. 4, where the skate, in addition to being canted vertically, likewise produces a canting or twist of the upper surface of the base lever with respect to the upper surface of the frame. When the skater's foot is realigned to a straightforward position, angle 491 will define the angle of canting or the inward purchase, and angle 493 will define the angle of heel with respect to a naturally straightforward foot. The heeling action likewise produces a positive benefit in assisting the skater to use an inward pulling stroke to propel himself forward. The benefits achieved by the embodiments of the present invention will enable the skater to use pulling as well as pushing strokes, effectively doubling the length of his stroke.

The foregoing discussion details a mechanical solution to the push/pull problem. Mechanically altered hinges are preferred for skates employed where not much ground is covered in a single push or pull stroke or as individual preference dictates. As a skater glides longer distances in a single stroke, the skate must be redirected inwardly at smaller and smaller angles. This is because the sideways distance covered by a skate from the end of the push stroke to the beginning of the next push stroke is generally constant. But, the distance covered during the same time period could be substantially longer in some sports, such as speed ice-skating. At some point, due to individual style or type of sport, a mechanically altered hinge becomes less efficient over a user-controllable push/pull skate. In a user controllable push/pull skate, the user controls whether the skate "klops", i.e., returns to the closed position. Push/pull skating is enabled by a klop skate with user-controllable klopping because maintaining the frame in an open position avoids digging the forward tip of the skate into the surface when the skate klops, such as when going around a turn, when the skater must cross one skate in front of the other.

Figure 10:
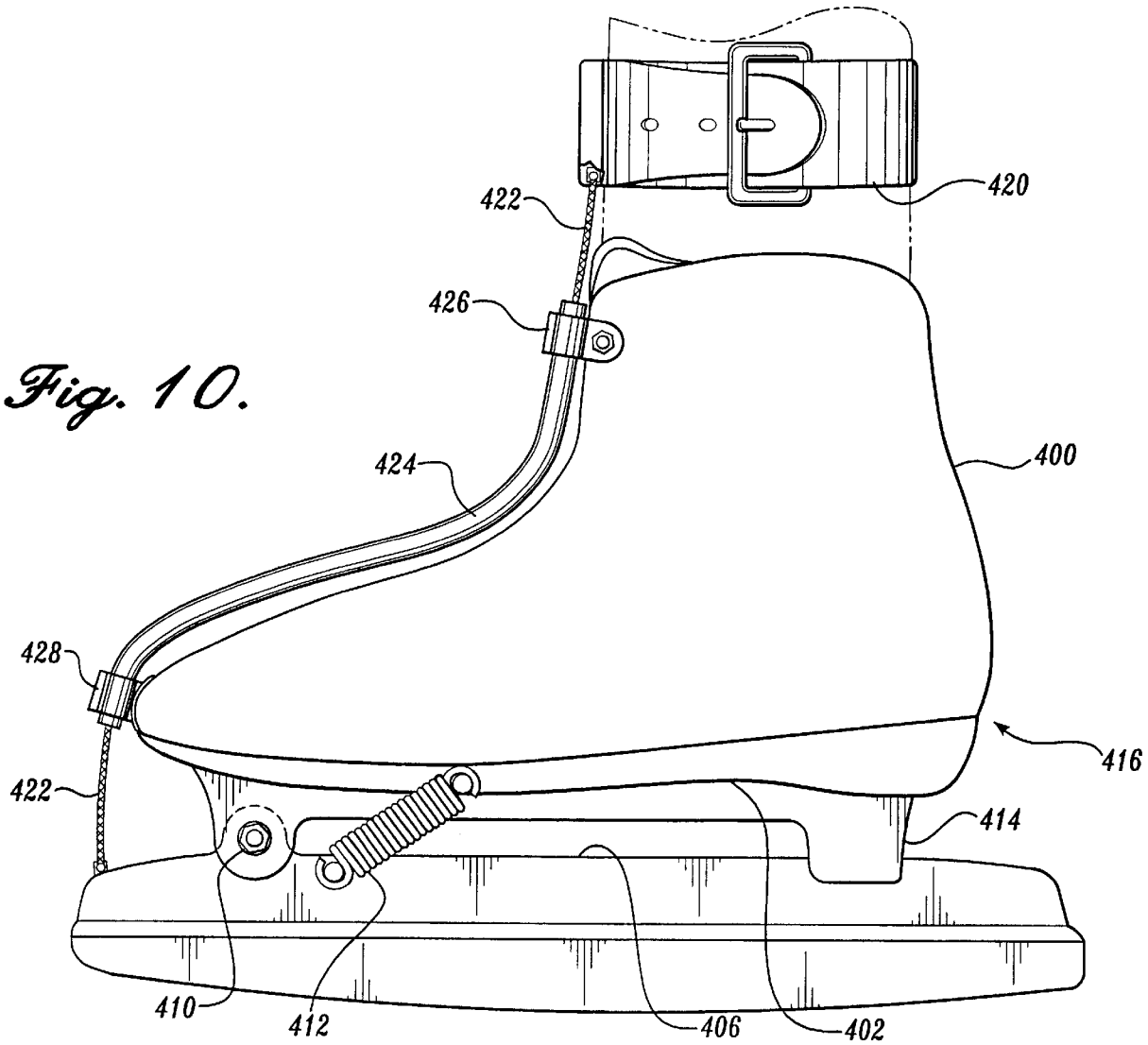
FIG. 10 provides a side plan view of a fourth preferred embodiment of the present invention.

Referring to FIG. 10, another preferred embodiment of the present invention is illustrated. FIG. 10 shows a klop skate with a shoe portion 400 having a base 402; a base lever 404 on the underside of the base 402; a base lever 404 on the underside of the base 402; and an elongate frame 406 for mounting the glide member 408. While an ice-skating blade is illustrated; alternates, such as a plurality of in-line wheels, can be used as the glide member. The frame 406 is pivotally attached to the base lever 404 at the forward end of the skate. A hinge 410, defining a pivot axis, operably couples the frame 406 to the base lever 404 to allow the frame 406 to swing about the pivot axis circumscribing an arc. A coil spring 412 biases the frame 406 to the base lever 404. Although, a coil spring is illustrated, other biasing devices, such as leaf springs or elastomeric materials can be used as alternates. The frame 406 normally rests on a klop bracket 414 located at the heel region 416 of the shoe base 402.

The skate of FIG. 10 includes a control device, generally denoted by 418. The control device 418 includes several components. The control device 418 includes a cuff 420 to attach to the skate-wearer around a lower portion of a leg. The cuff 420 is connected to a force transmission linkage such as a flexible cable 422. One end of the cable 422 is connected to the forward facing portion of the cuff while a second end is connected to the forward end of the frame 406. Connectors may include ball and socket joints to provide articulation at connection points or the cable may terminate as a loop or an eye. Other connectors not mentioned but well known are also intended to be part of this disclosure. The cable is housed in a cable housing 424. The housing 424 is secured to the shoe upper 400 at points proximally and distally of the leg, preferably at the end points by holders 426, 428. The housing is located along the upper shoe surface. The distal attachment at the frame 206 is forward of the hinge 410, therefore a levering effect is created to counter the spring by tensioning the cable 422.

A skate constructed as described provides a control device to enable the skate-wearer to selectively control whether the frame klops closed. The skate-wearer selects whether to maintain the frame open by applying tension to the cable. As the cable is tensioned, a force is applied to the frame that opposes the biasing force due to the spring. Alternatively, a skate-wearer can cause the frame to pivot by overcoming the resistance offered by the spring, again by applying a tension on the cable. The skate-wearer applies tension by distally flexing the foot at the ankle.

Figure 11:
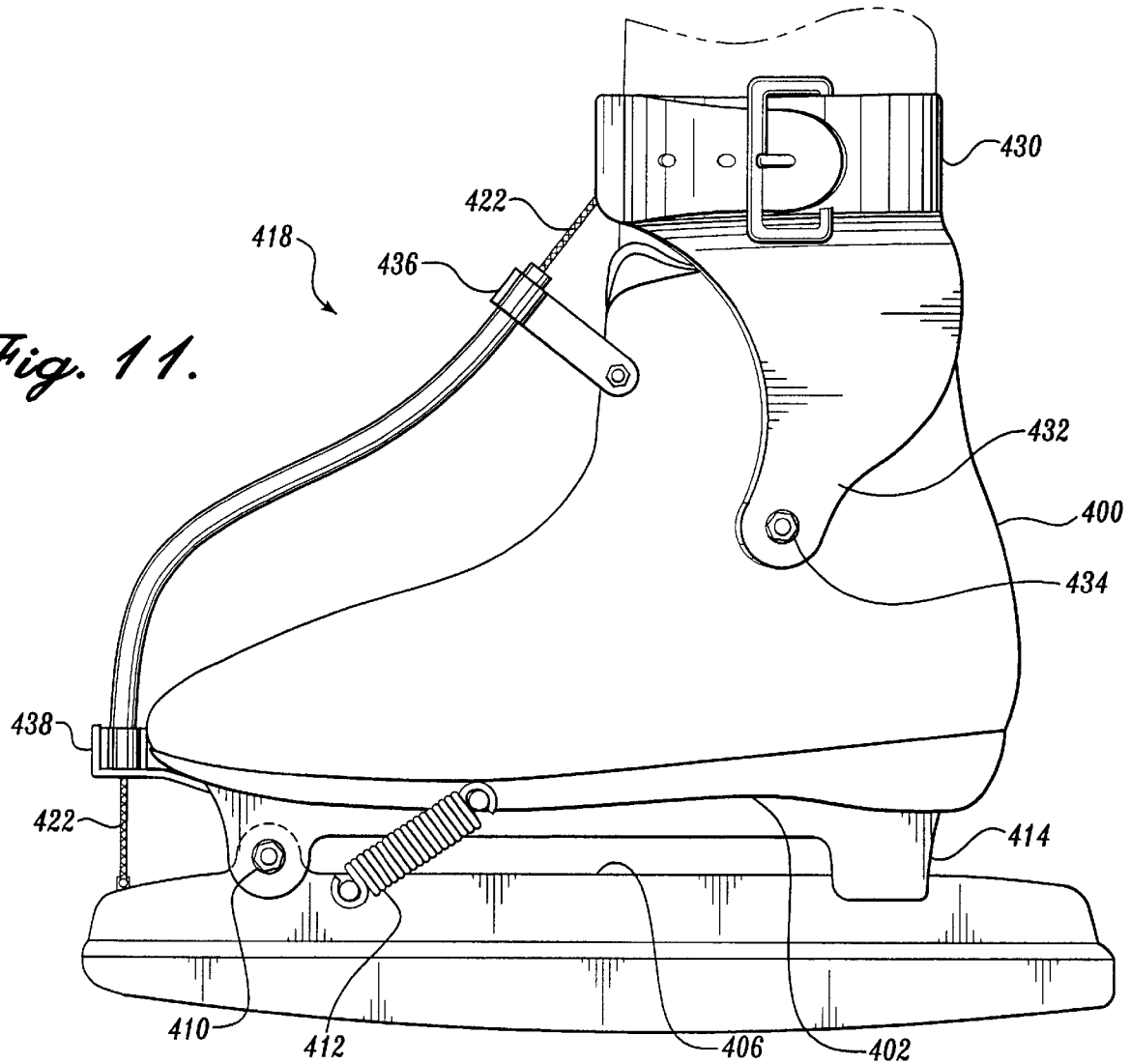
FIG. 11 provides a side plan view of a fifth preferred embodiment of the present invention.

FIG. 11 shows an alternate of the skate of FIG. 10. The skate of FIG. 11, is meant to be similar in operation to the skate of FIG. 10, except the cuff 430 of FIG. 11 extends into the shoe upper 400 and is pivotally secured at suitable locations. The pivoting cuff 430 has lateral and medial side extensions 432 which fit over medial and lateral sides of the shoe portion, respectively, and are secured to the sides with a pivoting connector 434. A pivotally secured cuff 430 has the added advantage of being stably secured to the shoe portion. Cable holders 436, and 438, may have to be repositioned or extended to allow for the changed cuff configuration. Otherwise, the control device 418 operates similarly as the previous skate.

Figure 12:
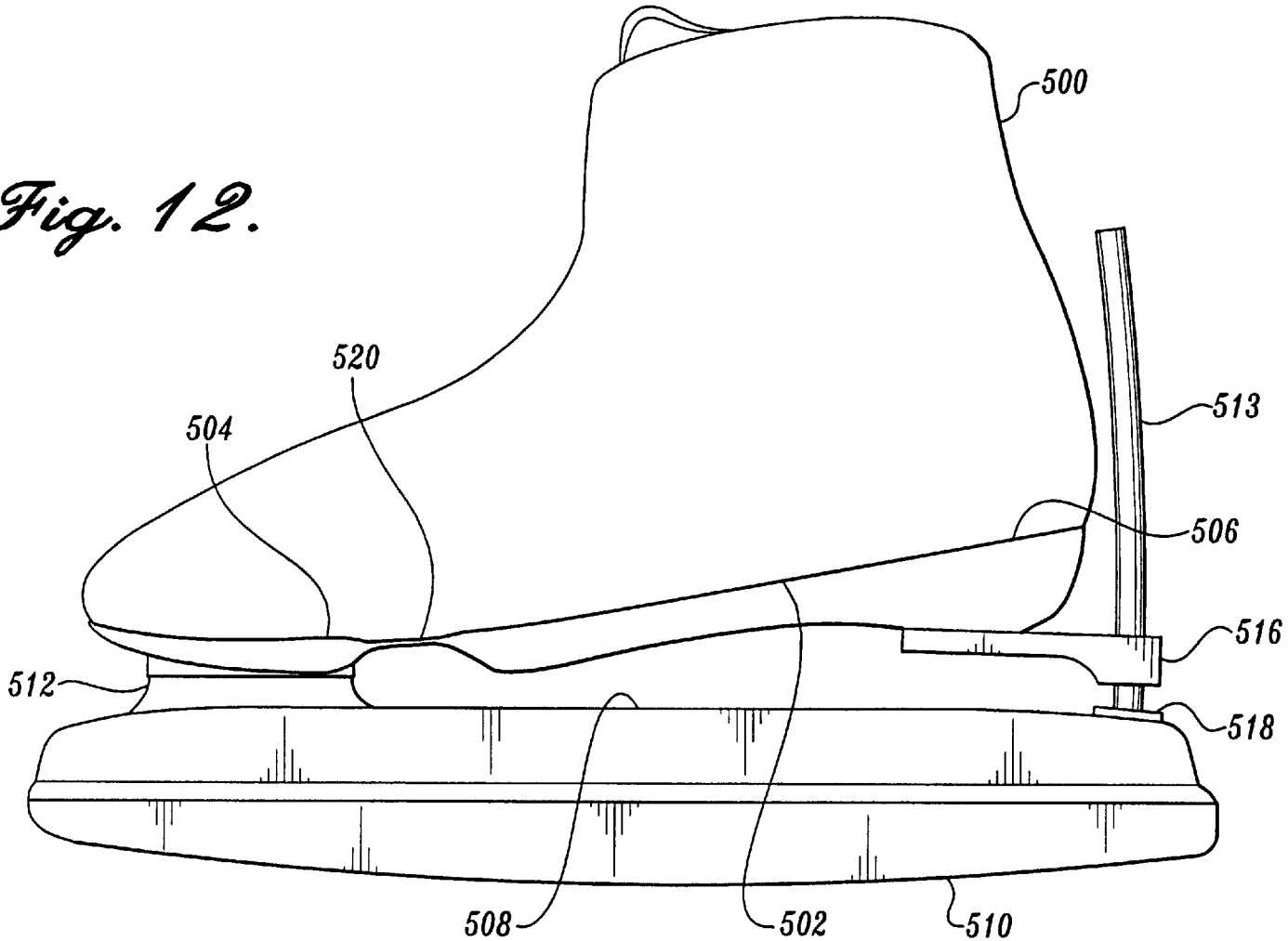
FIG. 12 provides a side plan view of a sixth embodiment of the present invention.

FIG. 12 shows another preferred embodiment of a skate constructed in accordance with the present invention. The skate of FIG. 12 includes a shoe portion, having a base 502, wherein the base has a forefoot region 504 and a heel region 506. The skate includes a frame 508 for mounting the glide member 510. The frame 508 is secured to the base 502 by screws or rivets (not shown) covered by a composite material 512 at the forefoot region. The forefoot region 504 of the shoe base 502 is adapted to flex during skating. The construction and advantages of a flexing base are further described in U.S. patent application Ser. No. 09/094,425, which is herein incorporated by reference. While many advantages are attained by the previous application, the flexing base of the present invention is neutrally biased, meaning that the base flexing region 520 produces little to no upward biasing of the frame 508 against the base 502. Little to no upward biasing means that the base is intentionally constructed having about zero flex strength, or stated another way, bias is substantially reduced by selection of a resilient base material with little spring force, such as leather, or that is reduced in thickness at least at the point of flexion, such as a thermoplastic base that is transversely grooved on the underside of the base. While it is to be appreciated that many materials have a natural tendency to resist bending, and inherently possess an integral biasing force which returns the material to its original shape; efforts have been expended into the development of a base having little to no flex strength, other than what is to be expected of the natural tendency inherent to many materials to resist bending. Little to no flex strength can also be gauged by the efforts required to maintain the base in a flexed state. Preferably, the base of the present invention is constructed so as to facilitate holding open the frame by the skate-wearer flexing the base without expending energy to bring about undue muscular fatigue of the forward foot. While the base exerts little to no upward force on the frame, the device is constructed to prevent the frame from flopping downward, as when occurs in a conventionally hinged skate with no spring. This is to prevent loss of skate control when a skate-wearer is forced into lifting a skate off the surface, as when a skater rounds a corner, the skater must cross one skate in front of the other. Thus, the flexing base hinge, while not constructed to significantly bias the frame to the base, is constructed to have sufficient resistance to unrestricted movement of the frame away from the shoe base to counter the weight of the frame and to prevent the frame from flopping open.

The skate of FIG. 12 also includes a guide 514 located on the rear of the frame 508. A follower 516 is secured on the underside of the heel portion 506 of the base. The guide projects upward from the frame and is curved to define the arc of the frame travel. The follower engages the guide to prevent the shoe portion from torsionally flexing out of line with the frame. A pad 518 is located on the lower end of the guide 513 and rests on the frame 508. The pad acts as a cushion between the follower 516 and the frame 508.

A further embodiment includes a pivoting frame and base combination. However, in this alternate embodiment the frame is balanced on either side of the pivoting axis to provide a substantially zero or positively biased frame, meaning the frame is not biased upward against the base. The zero balanced frame can be accomplished by a pair of opposing springs, one on either side of the pivoting axis. In a positively balanced frame, the one spring that biases the frame away from the base is predominent such that the frame is biased away from the base. The balanced frame can also be accomplished by a frictional hinge. In the latter, the frame assumes the position to which it is moved and a slight force to overcome friction, such as the weight of the skate-wearer, is required thereafter to move the frame.

Figure 13:
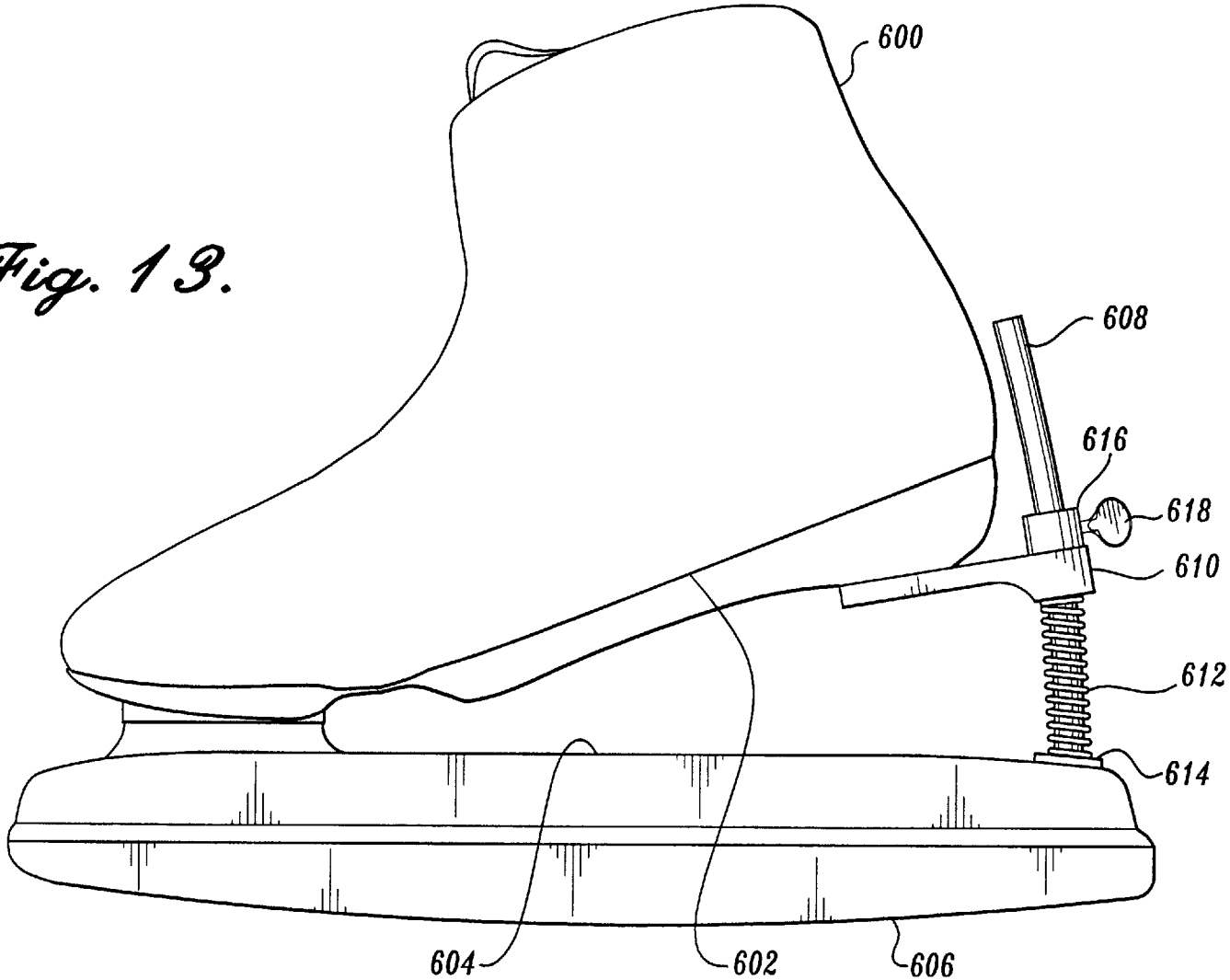
FIG. 13 provides a side plan view of a seventh preferred embodiment of the present invention.

FIG. 13 shows another preferred embodiment of a klop skate. The skate includes a shoe portion 600, a base 602, and a frame 604 with a glide member 606. The base 602 is a flexing base. Moreover, in this embodiment, the flexing base 602 need not be neutrally biased. The embodiment of FIG. 13 has similar features of the skate of FIG. 12, such as guide 608 and follower 610, however, in this embodiment, the skate also includes a biasing device 612 to positively bias the frame 604 away from the shoe base 602. Biasing device 612 is a coil spring in this embodiment; but, elastomeric materials which are compressible and have memory to impart spring-like biasing effects can also be utilized as alternates to the coil spring. Memory acts to restore the elastomeric material to its relaxed state. The coil spring 612 is located on the guide 608, and positioned between a pad 614 and the follower 610. The spring 612 imparts outward rather than inward biasing forces to push the frame 508 away from the base 602, unlike conventional klop skates which have inward biasing springs. The amount of biasing is adjustable by a controller. An adjustable controller is provided in the form of a collar 616 which slides on the guide 608 to adjust the amount of travel permitted between the frame 604 and the base 602. The adjustment is implemented by sliding the collar 616 within the guide 608, determining the suitable biasing effect desired, and setting the position of the collar 616 by snugging a thumbscrew fastener 618. However, other alternates of the stop can be used, such as clamps or pins. The skate of FIG. 13 is intended to perform in a similar manner as the skate of FIGS. 10, 11, and 12 by allowing a skater to maintain the frame in an open position. The skate forward tip will not dig into the ice, thereby facilitating the skater to cross one foot over the other, as in rounding a comer. This feature permits the skater to use a pulling as well as a pushing stroke.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A skate including a glide member for traversing a surface, comprising:

a shoe portion for receiving a skater's foot and including a base underlying the received foot;

a base lever defined on an undersurface of the base, the base lever defining a forward end portion, a forward base lever attachment structure defined by the forward end portion, and a longitudinal base lever axis aligned with a longitudinal axis of the received foot;

an elongate frame for mounting the glide member, the frame defining a longitudinal frame axis, a forward end portion, and a forward frame attachment structure; and a hinge, defining a pivot axis, pivotably connecting the forward end portion of the base lever to the forward end portion of the frame, wherein upon pivoting of the base lever with respect to the frame, the longitudinal base lever axis, projected onto a horizontal plane passing through the longitudinal frame axis, defines a first angle of canting with respect to the longitudinal frame axis.

2. A skate including a glide member for traversing a surface, comprising:

a shoe portion for receiving a skater's foot and including a base underlying the received foot;

a base lever defined on an undersurface of the base, the base lever defining a forward end portion, a forward base lever attachment structure defined by the forward end portion, and a longitudinal base lever axis aligned with a longitudinal axis of the received foot; and an elongate frame for mounting the glide member, the frame defining a longitudinal frame axis, a forward end portion and a forward frame attachment structure, wherein the forward base lever attachment structure is pivotally connected to the forward frame attachment structure, the base lever being pivotable with respect to the frame such that the longitudinal base axis passes through a base lever plane that defines a first angle of canting with respect to a frame plane defined by and extending vertically upward through the longitudinal frame axis.

3. The skate of claim 2, wherein the pivotal connection between the base lever forward attachment structure and the frame forward end defines a hinge having a pivot axis that is vertically canted, with the pivot axis of the hinge defining a second angle of canting with respect to a horizontal plane passing through the longitudinal axis of the frame.

4. The skate of claim 3, wherein the frame forward attachment structure further comprises:

the forward end portion of the frame having a medial and lateral side with their respective inner surfaces defining a space therebetween, the respective inner surfaces defining an angle with respect to a vertical plane passing through the longitudinal axis of the frame, the medial and lateral sides each defining an aperture for mounting the hinge.

5. The skate of claim 4, wherein the base lever forward attachment structure further comprises:

the forward end portion of the base lever having angled side surfaces to mount in the space between the medial side and the lateral side of the forward end portion of the frame, the base lever forward attachment structure defining a passage for mounting the hinge throughbetween.

6. The skate of claim 5, wherein the hinge further comprises:

an elongate pin mounted through the apertures defined in the medial and lateral sides of the frame, such that the ends of the pin are at varying vertical heights at their respective side of the frame and the pin traverses through the passage defined by the base lever forward attachment structure.

7. The skate of claim 6, wherein the frame heels to the side relative to the base, upon pivoting of the base lever with respect to the frame.

8. The skate of claim 7, wherein the glide member comprises:

a plurality of wheels, having their axis of rotation perpendicular to the longitudinal axis of the frame, wherein the wheels are attached to a lower portion of the frame substantially in an in-line fashion.

9. The skate of claim 3, wherein the frame forward attachment structure further comprises:

the forward end portion of the frame having a planar shaped tab projecting substantially vertically upward, wherein the tab is mounted medially or laterally with respect to the longitudinal axis of the frame, the planar shape of the tab defining an angle of canting with respect to a vertical plane passing through the longitudinal axis of the frame, the tab defining an aperture for mounting the hinge therethrough.

10. The skate of claim 9, wherein the base lever forward attachment structure further comprises:

the forward end portion of the base lever having two angled planar shaped ears projecting substantially vertically downward, each of the ears being mounted medially and laterally with respect to the longitudinal axis of the base, such that the two ears define a space for placement of the tab therein, the two of the ears each defining an aperture for mounting the hinge.

11. The skate of claim 10, wherein the hinge further comprises:

an elongate pin mounted within the apertures defined on the medial and lateral ears, such that the pin traverses through the aperture defined by the tab.

12. The skate of claim 11, wherein the frame heels to the side relative to the base, upon pivoting of the base with respect to the frame.

13. The skate of claim 12, wherein the glide member comprises:

an ice skating blade aligned substantially parallel to the longitudinal axis of the frame, and mounted on a lower portion thereof.

14. The skate of claim 3, wherein the hinge is adjustable, such that the second angle of canting may be varied vertically.

15. The skate of claim 2, wherein the pivotal connection between the base lever forward attachment structure and the frame forward attachment structure, defines a hinge having a pivot axis that is horizontally canted, the pivot axis of the hinge defining a third angle of canting with respect to a vertical plane perpendicular to the longitudinal axis of the frame.

16. The skate of claim 15, wherein the hinge is adjustable, such that the third angle of canting may varied horizontally.

17. The skate of claim 16, wherein the frame forward attachment structure further comprises:

a planar shaped mounting member attached proximate the forward portion of the frame, the mounting member defining medial and lateral sides, the medial side and the lateral side of the mounting member defining at least one passage for mounting the hinge, the planar shape lying substantially horizontally; and at least one fastener to securely hold the mounting member.

18. The skate of claim 17, wherein the base lever forward attachment structure further comprises:

the forward end portion of the base lever having two planar shaped ears projecting substantially vertically downward, the two of the ears being mounted medially and laterally with respect to the longitudinal axis of the base lever, such that the two ears define a space for placement of the mounting member therein, the two of the ears each defining an aperture for mounting the hinge.

19. The skate of claim 18, wherein the hinge further comprises:

at least one elongate pin defining a longitudinal axis, and mounted on at least one of the medial or lateral sides of the mounting member at the respective aperture defined on the medial and lateral side of the mounting member, such that the pin is received at least partially within the aperture.

20. The skate of claim 19, wherein the glide member comprises:

an ice skating blade aligned substantially parallel to the longitudinal axis of the frame, and mounted on a lower portion thereof.

21. The skate of claim 2, wherein the base lever forward attachment structure is pivotably connected to the frame forward attachment structure, such that a pivot axis of a hinge, defined thereby is vertically and horizontally canted, the hinge being adjustable vertically and horizontally.

* * * * *

UNITED STATES PATENT AND TRADEMARK OFFICE

CERTIFICATE OF CORRECTION

PATENT NO. : 6,736,412 B1
DATED : May 18, 2004
INVENTOR(S) : D. Krah

It is certified that error appears in the above-identified patent and that said Letters Patent is hereby corrected as shown below:

Title page,
Item [56], References Cited, FOREIGN PATENT DOCUMENTS,
"FR 0 599 403 6/1994" should read -- EP 0 599 043 6/1994 --

Column 20,
Line 63, "structure, defines" should read -- structure defines --

Column 21,
Line 2, "may varied" should read -- may vary --

Column 22,
Line 19, "hinge, defined" should read -- hinge defined --

Signed and Sealed this

Seventh Day of September, 2004

JON W. DUDAS
*Director of the United States Patent and Trademark Office*